US010709256B2

(12) United States Patent
Sramek

(10) Patent No.: US 10,709,256 B2
(45) Date of Patent: Jul. 14, 2020

(54) EFFICIENT MATTRESS HAVING LOW PRESSURE AND ALIGNMENT

(71) Applicant: Level Sleep LLC, Sonoma, CA (US)

(72) Inventor: Roger Anton Sramek, Tiburon, CA (US)

(73) Assignee: Level Sleep LLC, Sonoma, CA (US)

( * ) Notice: Subject to any disclaimer, the term of this patent is extended or adjusted under 35 U.S.C. 154(b) by 437 days.

(21) Appl. No.: 14/967,269

(22) Filed: Dec. 12, 2015

(65) Prior Publication Data

US 2017/0164761 A1 Jun. 15, 2017

(51) Int. Cl.

| | |
|---|---|
| ***A47C 27/14*** | (2006.01) |
| ***A47C 27/15*** | (2006.01) |
| *A47C 31/00* | (2006.01) |

(52) U.S. Cl.

CPC ..... *A47C 27/148* (2013.01); *A47C 27/15* (2013.01); *A47C 31/001* (2013.01)

(58) Field of Classification Search

CPC ..... A47C 27/00; A47C 27/002; A47C 27/14; A47C 27/148; A47C 27/15; A47C 31/105; A47C 31/123; A47G 9/0246

See application file for complete search history.

(56) References Cited

U.S. PATENT DOCUMENTS 4,372,309 A 2/1983 Fowler
5,802,646 A * 9/1998 Stolpmann ..... A47C 27/146 5/730
5,960,496 A * 10/1999 Boyd ..... A47C 27/144 5/722
7,966,680 B2 * 6/2011 Romano ..... A47C 27/122 5/423
2003/0221262 A1 * 12/2003 Torbet ..... A47C 27/082 5/713
2004/0172754 A1 * 9/2004 Brooks ..... A47C 27/002 5/499
2005/0210595 A1 * 9/2005 Di Stasio ..... A47C 21/046 5/740
2008/0201856 A1 * 8/2008 Howard ..... A47C 27/001 5/690

(Continued)

FOREIGN PATENT DOCUMENTS

CN 201200173 4/2009
DE 202011002218 U1 * 5/2011 ..... A47C 21/046

(Continued)

*Primary Examiner* — Nicholas F Polito
(74) *Attorney, Agent, or Firm* — Benjamin Aaron Adler

(57) ABSTRACT

A mattress that efficiently provides low pressure and alignment to achieve restful and less fragmented sleep. The mattress supports a recumbent body. The mattress comprises a composite and a cover encapsulating the composite. The composite includes a performance layer and a core layer. The performance layer includes a shoulder section, a thoracic section and a hip section for location at different longitudinal positions corresponding to the shoulder region, the thoracic region and the hip region of the recumbent body. The shoulder section, the thoracic section and the hip section have different displacement parameters to match the body displacements in the shoulder region, the thoracic region, and the hip region for alignment of the body with low body pressure. A core layer supports the performance layer.

18 Claims, 10 Drawing Sheets

(56) References Cited

U.S. PATENT DOCUMENTS

| | | | | |
|---|---|---|---|---|
| 2009/0171864 | A1* | 7/2009 | Stagner | G06Q 30/0242 705/500 |
| 2010/0090383 | A1* | 4/2010 | Rawls-Meehan | A47C 7/027 267/145 |
| 2012/0124753 | A1* | 5/2012 | Lee | A47C 27/144 5/727 |

FOREIGN PATENT DOCUMENTS

| | | | | |
|---|---|---|---|---|
| EP | 2954802 | A1 | 12/2015 | |
| JP | 6379964 | B2 * | 8/2018 | A47C 27/146 |
| WO | 2014121665 | A1 | 8/2014 | |

* cited by examiner

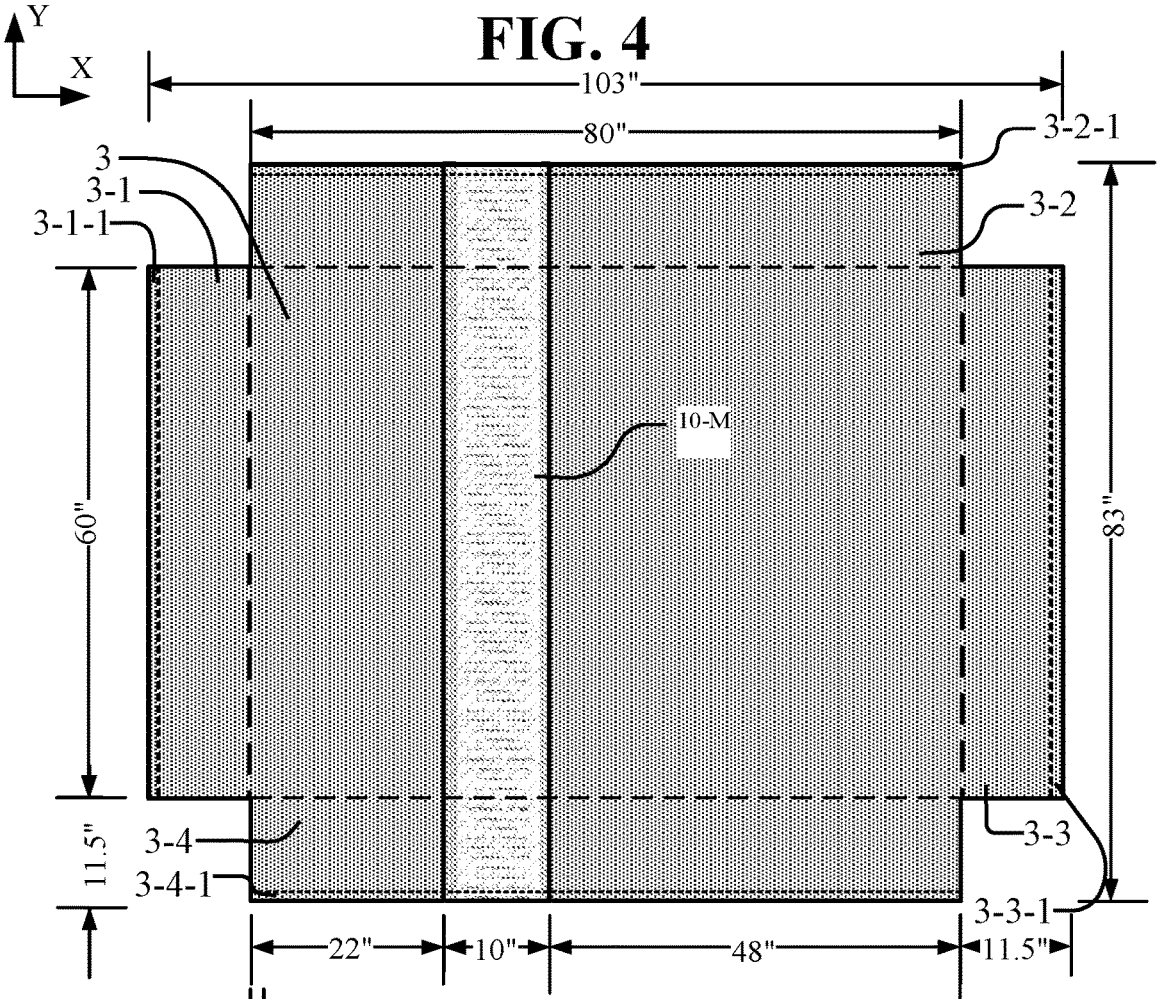
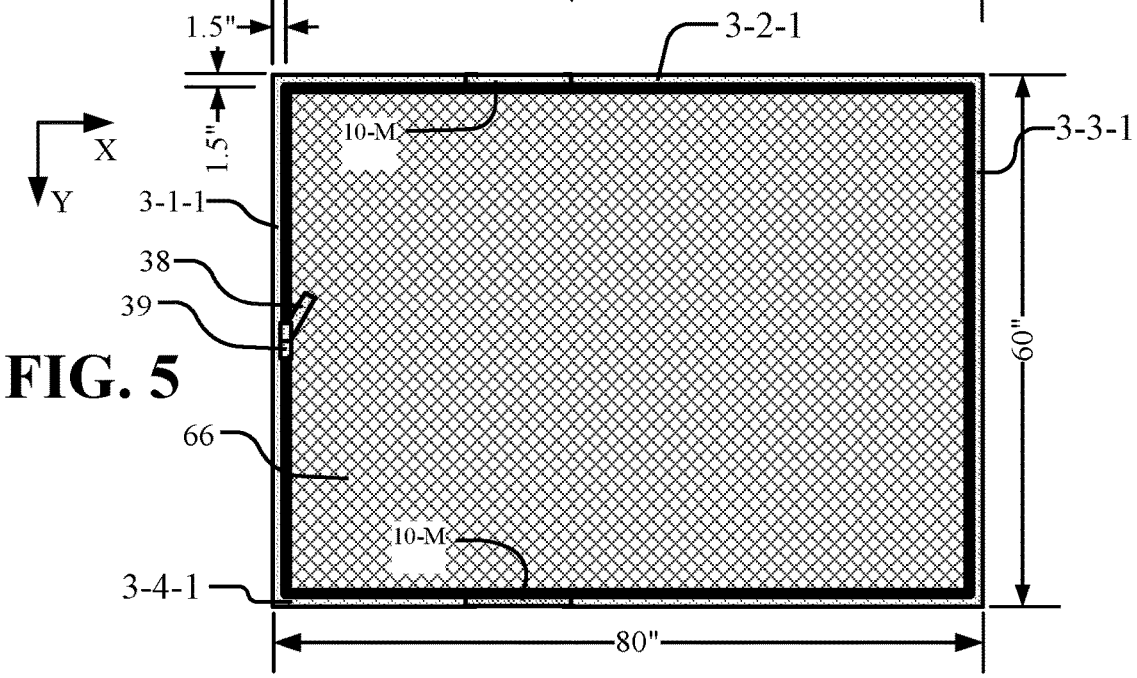
FIG. 5

Z
X
136
1-1
18
10-2
10-3
10-1
5-2'
5-1'
$1_1$
11
P1
P2
P3
$1^{ST}$
$2^{ND}$
$3^{RD}$

Z
X
18
135
10-2
10-3
10-1
11
$1_1$
P1
P2
P3
$1^{ST}$
$2^{ND}$
$3^{RD}$

Z
X
135
31
31-2
19-2
10-3
11
10-1
$1_1$
32
10-2
31-1
19-1
P1
P2
P3
$1^{ST}$
$2^{ND}$
$3^{RD}$

EFFICIENT MATTRESS HAVING LOW PRESSURE AND ALIGNMENT

BACKGROUND OF THE INVENTION

This invention relates to mattresses, to mattresses for beds and to mattresses that efficiently provide low pressure and alignment to achieve restful and less fragmented sleep.

Normally, everyone spends a large percentage of everyday sleeping. Restful sleep is important to a person's good health, enjoyment of life and the ability to function normally. Sleep affects brain activity, heart rate, blood pressure, sympathetic nerve activity, muscle tone, blood flow, sexual arousal, body temperature and other body conditions. Poor sleep has a strong correlation to obesity, diabetes, stroke, depression, hypertension and other adverse conditions.

Restful sleep is dependent upon a person's comfort level while recumbent, usually in side-lying and back-lying positions. The concentration of pressure on certain parts of the body and poor body alignment are significant causes of restless sleep.

During sleep, a healthy person typically passes through four levels of sleep which include physically restorative stages I-III and which additionally includes a REM (Rapid Eye Movement) sleep stage, the mentally restorative stage. Stages I and II are the lightest sleep and stage III is the deepest, the Stages I, II and III are non-REM stages (NREM). The REM stage is that level in which sleepers dream and receive mental health benefits. All levels of sleep are important, but stage III is the deepest and most physically restful sleep, when, for example, human growth hormone is secreted. Normal sleep cyclically passes through the stages from I to III and back from III to I and into and out of REM. This sleep cycle is repeated a number of times over a normal sleep period, but can be disrupted due, for example, to body discomfort.

Restfulness and the quality of sleep (mentally and physically restorative sleep) are dependent upon the comfort of sleepers. When sleepers become uncomfortable, they move to relieve the discomfort and the resulting moves are a normal part of sleep. When sleepers move, they frequently change to lighter stages of sleep or awaken. The more discomfort sleepers feel, the more they will move and the more time they will spend in lighter and less restful sleep. Good sleeping is normally associated with a minimum number of interruptions of sleep stages due to a low number of body shifts during the sleep period. The higher the number of interruptions, the more fragmented the sleep and the less restful the sleep.

Comfortable mattresses are important in establishing restful sleep. Bed-induced shifts due to discomfort caused by the bed are a significant cause of poor sleep quality. On conventional mattresses (including feather beds, inner spring mattresses, foam mattresses, orthopedic mattresses, waterbeds, airbeds and the like), most people experience as many as forty major postural body shifts in the course of a night's sleep. Poor sleepers experience as much as sixty percent more major shifts than good sleepers. While some shifts during a sleep period are beneficial, the quality of sleep can be greatly improved for many by reducing the number of bed-induced shifts.

There are two major causes of bed-induced shifting that cause poor sleep. The first major cause of shifting is excessive pressure on parts of the body and the second major cause of shifting is the body's spinal misalignment.

Considering the first major cause of shifting, the buildup of pressures results from prolonged lying in the same position. On conventional mattresses, the pressure tends to be greatest on the body's protrusions (such as shoulders and hips) where body tissues are put in high compression against the mattress. High compression tends to restrict capillary blood flow which is recognized by the body, after a period of time, as discomfort. The amount of pressure which causes a discontinuance of capillary blood flow is called the ischemic pressure. The ischemic pressure threshold is normally considered to be approximately thirty mmHg. The discontinuance of capillary blood flow is observable as a red spot on the skin (reactive hyperemia). After pressure is applied, a red spot on the skin is a precursor to tissue damage. When parts of the body (usually shoulders and hips in conventional mattresses) are subjected to pressures above the ischemic threshold, discomfort results and, hence, a person shifts to remove the discomfort and threat to tissue damage.

Considering the second major cause of shifting, body misalignment results from spinal misalignment due to lateral bending of the vertebral column of the body, particularly for a person in a side-sleeping position. Such lateral bending is typically caused by mattresses that allow sagging of the torso region of the body. Conventional mattresses allow such sagging regardless of the hardness or the softness of the mattress but the spinal sagging effect tends to be more pronounced on firm mattresses. A sagging mattress allows the upper torso (thoracic region) to drop relative to the hips and results in stress to muscles and ligaments. The stress from a sagging mattress frequently manifests as discomfort or even pain in the lumbar region of the back. Such discomfort causes the sleeper to shift in order to relieve the discomfort and avoid tissue damage.

Similarly, when lying in the supine position, the hips form a higher support point than the lumbar region of the spine. A flattening of the lumber spine due to gravity then occurs and this, again, brings stress to the soft tissues and causes a turning away from this position to avoid discomfort and tissue damage.

In U.S. Pat. No. 6,807,698, a bed having low body pressure and alignment includes a mattress for supporting a recumbent body. The mattress includes a resilient top member having a top region possessing uniform placement parameters and also includes resilient supporting means supporting the top member with variable displacement. The combination of members with uniform displacement parameters over members with variable displacement parameters enables the mattresses to support the body in alignment and with uniform low pressure.

In U.S. Pat. No. 7,036,172, a bed having low body pressure and alignment includes a mattress supporting a recumbent body with low body pressure and in alignment. The mattress extends in a lateral direction from side to side and extends in a longitudinal direction from a mattress head to a mattress foot where the mattress includes a head part, a shoulder part, a thoracic part, a hip part and a leg part. The recumbent body has a displacement profile that causes the mattress to undergo differing displacements when supporting the recumbent body. The mattress composite has displacement parameters varying to match the displacement profile of the recumbent body while supporting the recumbent body with low body pressure. The composite has a plurality of regions where the displacement in one or more of the regions varies to match the displacement profile of the recumbent body to maintain the recumbent body in alignment.

An ideal mattress has a resiliency over the length of a body on the mattress to support the body in spinal alignment and also has a low surface body pressure over all or most parts of the body in contact with the mattress. Since a recumbent body has both varying density and varying contour in the longitudinal direction, the ideal mattress must conform to these variations. With such variations, in order to achieve spinal alignment, the supporting forces in the mattress, under load from the recumbent body, must vary along the body to match the varying body density and shape. Also, when the body is in spinal alignment, for an ideal mattress, the supporting pressures in the mattress against the skin must be low. The preferred pressure against the skin of a person in bed for an ideal mattress is generally below the ischemic threshold. The preferred side-lying spinal alignment for a person in bed is generally defined as that alignment in which the spine is generally straight and on the same center line as the legs and head, a condition that helps provide "spinal neutrality". "Spinal neutrality" is a condition in which the forces on the spine and ligaments have minimum stress, for example, the shear forces on the L1 and L5 vertebrae are a minimum.

While the general principles of an ideal mattress have been recognized, actual embodiments of mattresses that have properties that approach the properties of an ideal mattress at reasonable costs have not been fully satisfactory.

Developments in the parameters of and manufacturing capabilities for foam and other materials have provided new components for mattresses that can be used to better approach the technical parameters required for an ideal mattress at economical costs and which can be manufactured with expected standard properties and with the attributes for mattresses that are desired by the public.

There are a number of properties useful in characterizing mattress materials including "Hardness", "Density", "Indentation Load Deflection (ILD)" and "Tensile Strength". Hardness is the resistance against pressure. Density is the mass per unit volume. Hardness and density are interrelated. When density increases, hardness tends to increase. Generally for lower density materials, a growing loss in hardness arises after repeated loading. Tensile Strength is the measure of the resistance against stretching and changes in tensile strength are measured as Tensile % and changes in length after applying a tensile force are measured as Elongation %. Indentation Load Deflection (ILD) is a hardness measurement defined in the ISO 2439 standard. ILD in the standard is defined as the force that is required to compress material a percentage of its original thickness, that is, compressed 25%, 40% and 60% from its original thickness (using in the standard a circular plate of 322 cm.sup.2). These ILD's are designated ILD.sub.25%, ILD.sub.40% and ILD.sub.60%.

In consideration of the above background, there is a need for improved mattresses that better approach the properties of ideal mattresses and that can be economically manufactured while satisfying the public expectations and demands for mattresses.

SUMMARY

The present invention is a mattress that efficiently provides low pressure and alignment to achieve restful and less fragmented sleep. The present invention is a mattress, extending in a lateral direction from side to side and extending in a longitudinal direction from a mattress head to a mattress foot for supporting a recumbent body. The recumbent body includes a shoulder region, a thoracic region and a hip region where the recumbent body has a displacement profile where the body displacements in the shoulder region, the thoracic region and the hip region are different. The mattress comprises a composite and a cover encapsulating the composite. The composite extends in the longitudinal direction and in the lateral direction. The composite includes a performance layer and a core layer. The performance layer includes a shoulder section, a thoracic section and a hip section for location at different longitudinal positions corresponding to the shoulder region, the thoracic region and the hip region of the recumbent body, respectively. The shoulder section, the thoracic section and the hip section have different displacement parameters to match the body displacements in the shoulder region, the thoracic region, and the hip region for alignment of the body with low body pressure. A core layer supports the performance layer.

In one embodiment, the performance layer is separated from the body only by the cover.

In one embodiment, the displacement parameters include ILD and density and the ILD of the thoracic section is greater than the ILD of the shoulder section and is greater than the ILD of the hip section.

In one embodiment, the ILD of the shoulder section is approximately 18, the ILD of the thoracic section is approximately 27 and the ILD of the hip section is approximately 23 and the density of the shoulder section is approximately 2 lb/cf, the density of the thoracic section is approximately 2 lb/cf and the density of the hip section is approximately 2 lb/cf.

In one embodiment, the performance layer and the core layer are polyurethane or latex.

In one embodiment, the cover includes a stretch material that allows depression of the body into the composite without significantly modifying load deflection parameters of the composite.

In one embodiment, the stretch material has a tensile strength that allows the cover to stretch approximately 12% or more in the longitudinal direction and approximately 16% or more in the lateral direction when a recumbent body is on the mattress.

The foregoing and other objects, features and advantages of the invention will be apparent from the following detailed description in conjunction with the drawings.

BRIEF DESCRIPTION OF THE DRAWINGS

FIG. 4 depicts a cover fabric lying in the XY-plane and to be used in covering a mattress composite.

FIG. 5 depicts the bottom view of a mattress with the cover of FIG. 3 attached to a bottom piece by a zipper.

DETAILED DESCRIPTION

Figure 1:
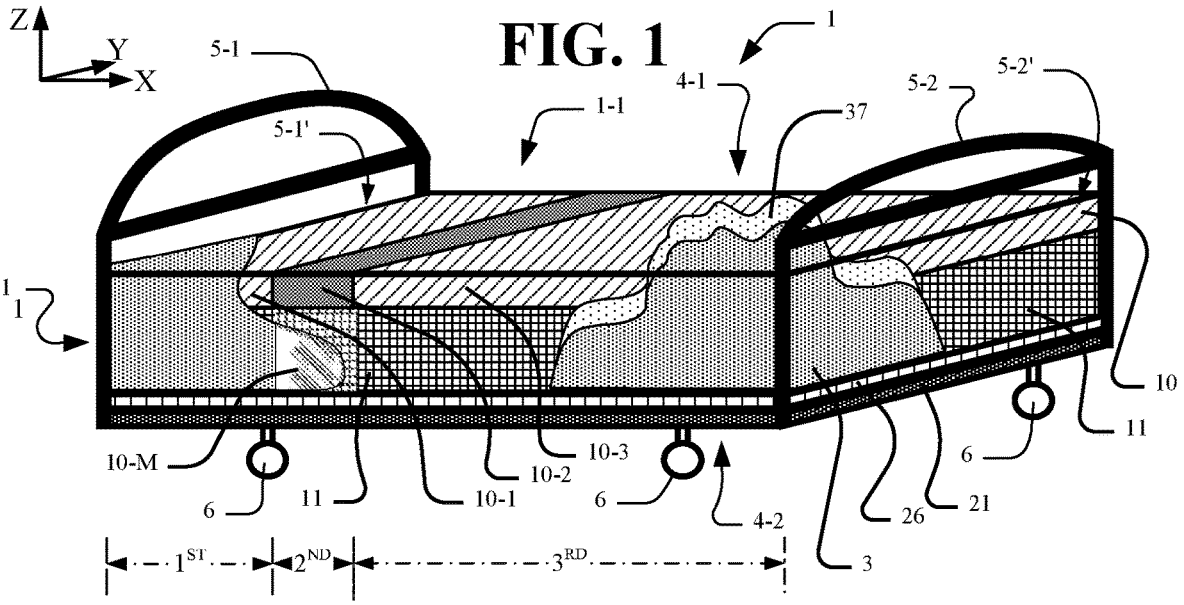
FIG. 1 depicts an isometric view of a bed including a mattress formed from foam layers having varying displacement parameters capable of supporting a recumbent body with low body pressure and in alignment.

FIG. 1 depicts an isometric view of a bed 1 having a mattress 1-1 which is capable of supporting a recumbent body (not shown) where the recumbent body is supported by low body pressure and where the recumbent body is maintained in alignment. The terminology "low body pressure" means a pressure which is below a pressure threshold (typically the ischemic threshold) for comfortable sleep and of a level which materially reduces the causes of bed-induced shifting. The terminology "maintained in alignment" means an alignment from head to foot of a body that avoids or reduces lateral bending of the vertebral column of the body, particularly for a person in a side-sleeping position, and that eliminates or reduces sagging of the body.

In FIG. 1, the bed 1 has a mattress 1-1 supported by a supporting foundation 26 and frame 21. The foundation 26 is a box spring, firm box, board or other conventional mattress support. The supporting frame 21 may be any frame and as shown in one embodiment is a conventional "Hollywood" or "Harvard" style of bed frame that is made from right-angled channels and is supported by legs 6 having casters. The bed 1 and mattress 1-1 extend in the longitudinal direction (X-axis direction) from a mattress head 5-1' at bed head 5-1 to a mattress foot 5-2' at bed foot 5-2. The bed 1 and mattress 1-1 also extend in the lateral direction (Y-axis direction) normal to the X-axis and extend in the vertical direction (Z-axis direction) normal to the plane formed by the X-axis and the Y-axis.

The mattress 1-1 is for supporting a recumbent person (see recumbent persons in FIG. 24 through FIG. 28, for example) where a person's recumbent body includes a head and shoulder part, a thoracic part, a hip part and a leg part. The mattress 1-1 supports a recumbent body positioned in the longitudinal direction with the head part toward the mattress head 5-1' and the leg part toward the mattress foot 5-2'. A body reclining on mattress 1-1 depresses portions of the mattress 1-1 causing the mattress to compress in the vertical direction (Z-axis direction) normal to the XY plane (formed by the X-axis and the Y-axis).

In the FIG. 1, the mattress 1-1 includes a composite $\mathbf{1}_1$ formed of foam member 10, including sections 10-1, 10-2 and 10-3 and a foam member 11. The term "foam" means rubber, plastic, latex, memory foam, urethane, polyurethane, polymer or other material having a cellular structure containing voids to make it soft and resilient, for example, a material filled with many small bubbles of air. The mattress 1-1 has a top side 4-1 and a bottom side 4-2. The members 10 and member 11 support and distribute the weight of a recumbent body (not shown). The members 10 have displacement parameters for providing supporting surface pressure to the recumbent body. The term "displacement parameters" refers to any and all the properties and characteristics of materials that determine the static and dynamic tension and compression properties of a mattress. The mattress 1-1 includes an outer cover 3 that encloses the inner foam member 10 and the foam member 11. The cover 3 is formed of stretch material which stretches in both the X-axis and Y-axis directions which sometimes is called a four way stretch. The amount of the stretch allows depression of a recumbent body into the composite $\mathbf{1}_1$ without significantly modifying the load deflection parameters of the composite $\mathbf{1}_1$.

The member 10 extends in the longitudinal direction (X-axis direction) from the head 5-1' to the foot 5-2'. The sections 10-1, 10-2 and 10-3 of the member 10 extend in rows in the lateral direction (Y-axis direction) to establish displacement parameters that vary in a least the vertical (Z-axis) direction as a function of the longitudinal position (X-axis position). The sections 10-1, 10-2 and 10-3 undergo different vertical compressions as a function of the longitudinal position (X-axis position) in order to follow the curvature of the recumbent body so as to establish alignment of the shoulder, thorax, hip and leg parts of a the body and so as to establish uniform low supporting surface pressure on the body.

In the embodiment of FIG. 1, the foam member 10 has different displacement parameters that determine the compression that occurs in the mattress 1-1 in response to a recumbent body. The sections 10-1, 10-2 and 10-3 of the member 10 function to divide the mattress 1-1 into $1^{ST}$, $2^{ND}$ and $3^{RD}$ regions. The $1^{ST}$ region is established by section 10-1 extending to the head of the mattress 5-1' and is for location beneath the head and shoulder parts of a recumbent body. The $2^{ND}$ region is established by the section 10-2 for location beneath the thoracic part of a body. The $3^{RD}$ region is established by the member 10-3 for location beneath the hip and leg parts of the body and extending to the foot of the mattress 5-2'. The sections 10-1, 10-2 and 10-3 of the member 10 have different displacement parameters that help establish the different compressions that occur in each of the $1^{ST}$, $2^{ND}$ and $3^{RD}$ regions in order to achieve alignment of a recumbent body with low supporting body pressure.

The mattress 1-1 includes a cover 3 formed, at least on the top portion, by a stretch fabric. The cover 3 is about 1/16 inch thick extending along the top, sides and bottom portions of the mattress 1-1. The cover 3 functions to cover and contain the inner members 10 and 11 of the mattress and the cover 3 has displacement parameters that provide a soft surface without interfering with the displacement parameters of the inner members 10 and 11 of the mattress 1-1. In some embodiments, the mattress 1-1 includes a fire retarding sock 37 encapsulating the composite $\mathbf{1}_1$. The sock 37 is a material that provides fire retardation and provides high stretch. The fire retarding sock 37 stretches in both the X-axis and Y-axis directions which sometimes is called a four way stretch. The amount of the stretch allows depression of a recumbent body into the composite without significantly modifying the load deflection parameters of the composite $\mathbf{1}_1$.

Figure 2:
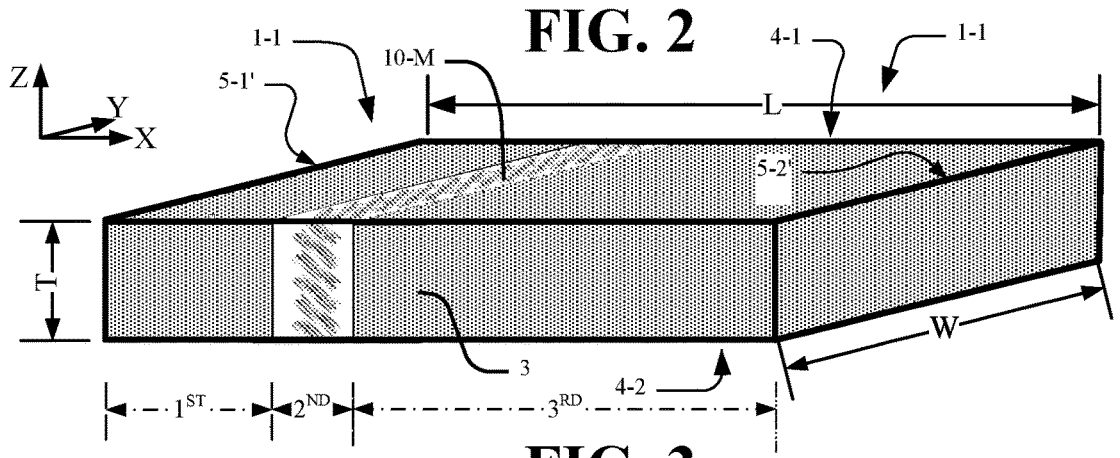
FIG. 2 depicts an isometric view of the mattress of FIG. 1.

In FIG. 2, the mattress 1-1 from the bed 1 of FIG. 1 is shown. The mattress 1-1 is for supporting a recumbent body positioned in the longitudinal direction with the head part toward the mattress head 5-1' and the leg part toward the mattress foot 5-2'. The mattress 1-1 includes $1^{ST}$, $2^{ND}$ and $3^{RD}$ regions for supporting a recumbent person where a person's recumbent body includes a head and shoulder part intended for the $1^{ST}$ region, a thoracic part intended for the $2^{ND}$ region and a hip part and a leg part intended for $3^{RD}$ region. A body reclining on mattress 1-1 depresses portions of the mattress 1-1 causing the mattress to compress in the vertical direction (Z-axis direction) normal to the XY plane (formed by the X-axis and the Y-axis).

In FIG. 2, the mattress 1-1 has a length L in the X-axis direction, a width W in the Y-axis direction and a thickness T in the Z axis direction. The L, W and T dimensions can be any values but typical values in the United States for one embodiment of mattresses are as set forth in the following TABLE 1.

TABLE 1

| | L | $1^{ST}$ | $2^{ND}$ | $3^{RD}$ | W | T |
|---|---|---|---|---|---|---|
| Twin | 75 | 20 | 8 | 47 | 39 | 10 |
| Twin Long | 80 | 22 | 10 | 48 | 39 | 10 |
| Full | 75 | 20 | 8 | 47 | 54 | 10 |
| Queen | 80 | 22 | 10 | 48 | 60 | 10 |
| Eastern King | 80 | 22 | 10 | 48 | 76 | 10 |
| California King | 84 | 22 | 10 | 52 | 72 | 10 |

In FIG. 2, the mattress 1-1 includes an indicator stripe 10-M that indicates the location of the thoracic section 10-2 of the layer 10 of mattress 1-1 of FIG. 1. The indicator stripe 10-M includes indicia such as text which identifies the head direction 5-1' of the mattress 1-1 as well as indicating the location of the thoracic section 10-2 beneath it. Typically, the indicator stripe 10-M is part of the cover 3 and in one embodiment is weaved into the cover material 3.

Figure 3:
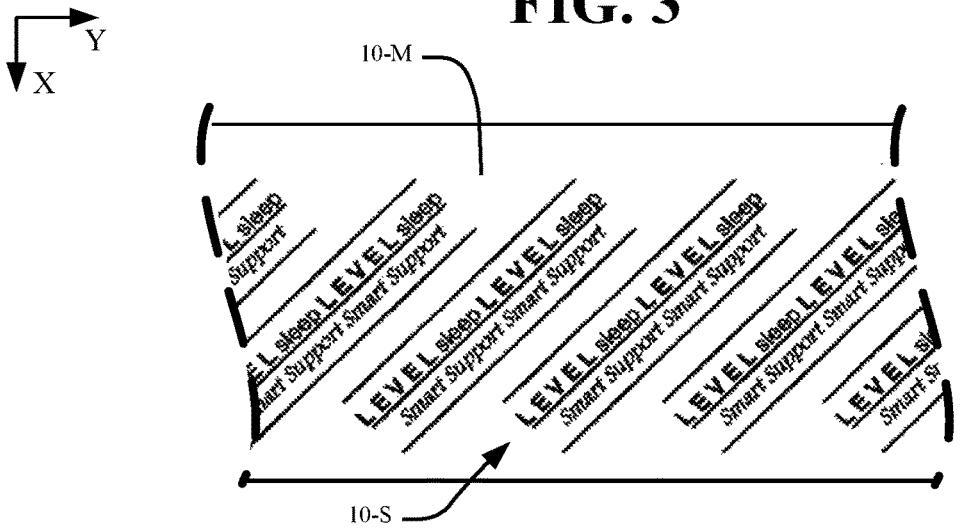
FIG. 3 depicts an expanded view of an indicator in the cover of the mattress of FIG. 1 and FIG. 2.

In FIG. 3, an expanded view of the indicator stripe 10-M in the cover 3 of FIG. 2 is shown. The indicator stripe 10-M includes indicia 10-S which in the embodiment shown is text "LEVELsleep Levelsleep" on the top and "Smart Support Smart Support" underneath. The text "LEVELsleep LEVELsleep" and "Smart Support Smart Support" is repeated multiple times in the Y-axis direction. As indicated in FIG. 2, the text is on the side of and extends all the way across the top of the mattress 1-1. A person standing on the side of the mattress 1-1 would tend to read text "LEVELsleep LEVELsleep" and "Smart Support Smart Support" in the right side up orientation when the indicator stripe 10-M is closer to the top 5-1 in the bed 1 of FIG. 1. Hence the text tends to identify the head direction 5-1' of the mattress 1-1. A person standing on the side of the mattress 1-1 would tend to read text "LEVELsleep LEVELsleep" and "Smart Support Smart Support" in the up side down orientation when the indicator stripe 10-M is closer to the bottom 5-2 in the bed 1 of FIG. 1. The up side down orientation tends to identify when the mattress 1-1 is being positioned in the wrong direction on the bed 1. The indicator stripe 10-M and indicia 10-S improves a user's appreciation of the biomechanical nature of the mattress.

In FIG. 4, a cover 3 (ticking) is shown lying in the XY-plane and is sized in FIG. 4 for a queen size mattress. The cover 3 is typically cut as a single piece from a role of fabric equal to or greater than 103" wide. The center portion of the cover 3 measures 80" by 60" and is surrounded by 11.5" extensions 3-1, 3-2, 3-3 and 3-4 indicated by broken lines around the 80" by 60" center. The overall dimensions of the cover 3 including extensions 3-1, 3-2, 3-3 and 3-4 is 103" by 83". The extensions 3-1, 3-2, 3-3 and 3-4 include terminating extensions 3-1-1, 3-2-1, 3-3-1 and 3-4-1 that are each about 1.5" from the outermost edges. To form the cover 3, each of the extensions 3-1, 3-2, 3-3 and 3-4 are folded in the Z-axis direction normal to the XY-plane of FIG. 4. The openings between the extensions 3-1, 3-2, 3-3 and 3-4 in the Z-axis direct are sewn or otherwise attached together so as to form a box-like structure around the mattress composite $\mathbf{1}_1$ of FIG. 1.

In FIG. 5, a bottom view of a mattress 1-1 of FIG. 1 and FIG. 2 is shown with the cover of FIG. 4 attached to a bottom piece 66 by a zipper 39 that is sewn or otherwise attached to the terminating extensions 3-1-1, 3-2-1, 3-3-1 and 3-4-1 on one side and to the bottom piece 66 on the other side. The zipper 39 is zipped and unzipped by the zipper handle 38. When unzipped, the cover 3 can be removed from the bottom piece 66 and the mattress composite $\mathbf{1}_1$ can be removed from the cover 3.

Figure 6:
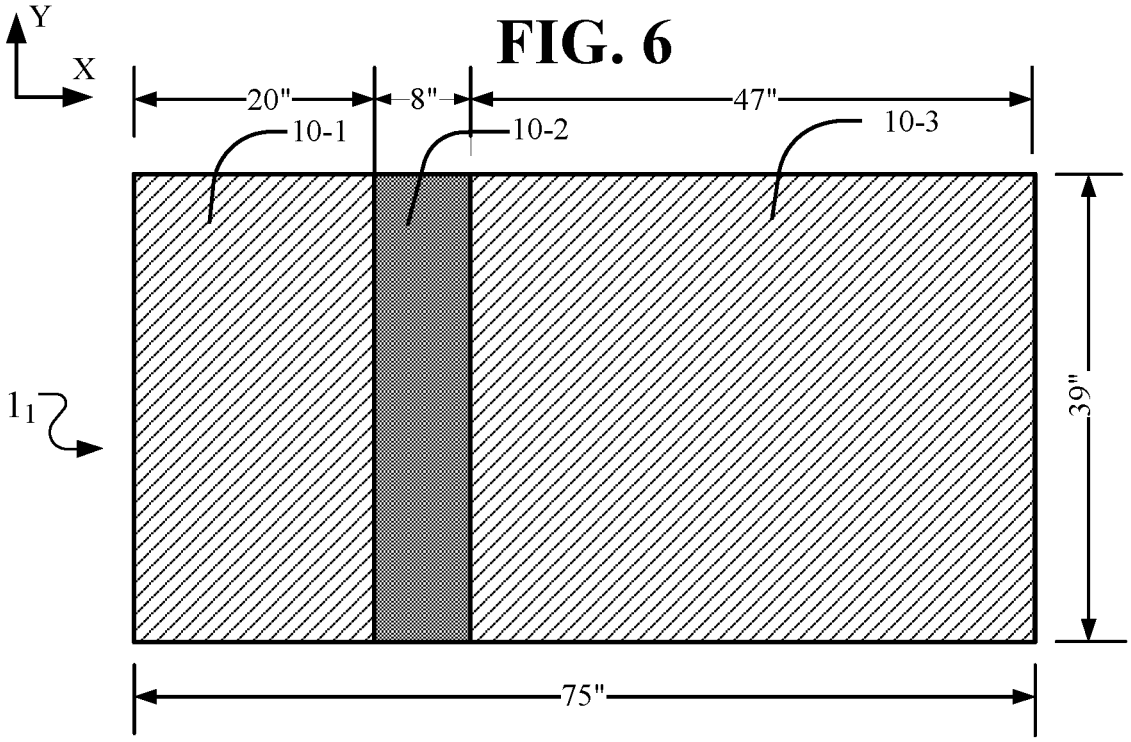
FIG. 6 depicts a top view of a mattress composite for a Twin size mattress.

In FIG. 6, a top view of a mattress composite $\mathbf{1}_1$ is shown in the XY-plane for a Twin size mattress 1-1 of the type shown in FIG. 1 and FIG. 2. The mattress composite $\mathbf{1}_1$ includes $1^{ST}$, $2^{ND}$ and $3^{RD}$ sections 10-1, 10-2 and 10-3, respectively, in the X-axis direction, each extending across in the Y-axis direction. The $1^{ST}$, $2^{ND}$ and $3^{RD}$ regions of the mattress composite $\mathbf{1}_1$ are for supporting a recumbent person where a person's recumbent body includes a head and shoulder part intended for the $1^{ST}$ region, a thoracic part intended for the $2^{ND}$ region and a hip part and a leg part intended for $3^{RD}$ region. A body reclining on a mattress having the composite $\mathbf{1}_1$ depresses portions of the sections 10-1, 10-2 and 10-3 in the vertical direction (Z-axis direction) normal to the XY plane (formed by the X-axis and the Y-axis). The $1^{ST}$, $2^{ND}$ and $3^{RD}$ sections 10-1, 10-2 and 10-3, respectively, in the X-axis direction each extend across the 39" width of the composite $\mathbf{1}_1$ in the Y-axis direction. In the X-action direction, the section 10-1 is 20", the section 10-2 is 8" and the section 10-3 is 47" whereby the composite $\mathbf{1}_1$ is 75" long in the X-axis direction.

Figure 7:
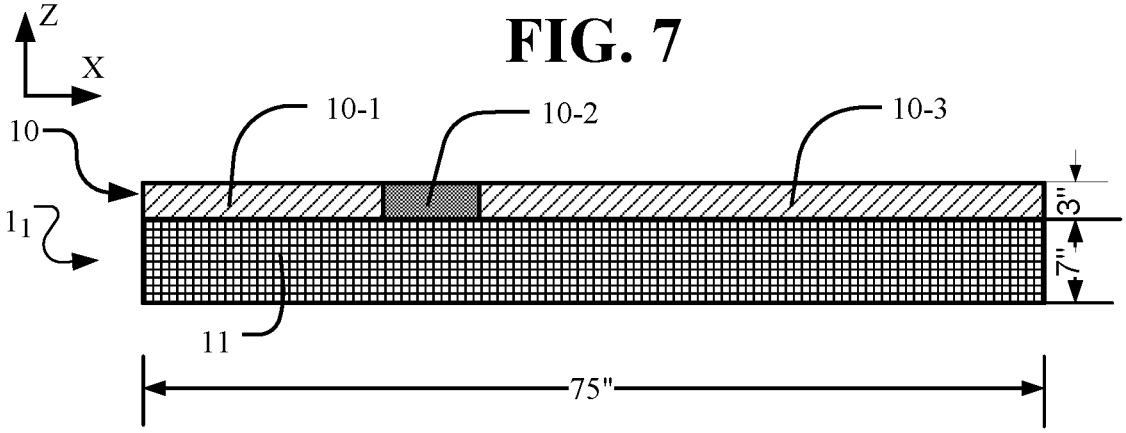
FIG. 7 depicts a front view of the mattress composite of FIG. 6.

In FIG. 7, a front view of a mattress composite $\mathbf{1}_1$ of FIG. 6 is shown in the XZ-plane. The mattress composite $\mathbf{1}_1$ includes layer 10 having $1^{ST}$, $2^{ND}$ and $3^{RD}$ sections 10-1, 10-2 and 10-3, respectively, in the X-axis direction, each extending across the 39" width of the composite $\mathbf{1}_1$ in the Y-axis direction. In the X-action direction, the section 10-1 is 20", the section 10-2 is 8" and the section 10-3 is 47". The layer 10 and each of the sections 10-1, 10-2 and 10-3 a 3" thick foam and are supported by a 7" foam layer 11.

The layer 10 is the performance layer which in one preferred embodiment is 3" thick in the Z-axis direction. The thickness can vary and typically is between 2" and 4". In the embodiment described, the section 10-1, for the head and shoulder region, is polyurethane foam with an ILD of 18, and a density of 2 lb/cf. In the embodiment described, the section 10-2, for the thoracic region, is polyurethane foam with an ILD of 17, and a density of 2 lb/cf. In the embodiment described, the section 10-3, for the hip and leg region, is polyurethane foam with an ILD of 23, and a density of 2 lb/cf. While the ILD's and densities are preferred for the embodiment described, these values may be different typically in a range of ±20%. While polyurethane foam is used in one particular embodiment, latex and other foams are also employed in other embodiments.

In the performance layer 10, the thoracic section 10-2 is more firm than the head and shoulder section 10-1 and the hip and leg section 10-3. With this relationship, the head and shoulder section 10-1 and the hip and leg section 10-3 are able to depress in the Z-axis direction greater than the depression of the thoracic section 10-2. This relationship helps to establish proper alignment of the recumbent body.

The core layer 11 is the base layer, for supporting the performance layer 10, and in one preferred embodiment is 7" thick in the Z-axis direction. The thickness can vary and typically is between 6" and 10". In the embodiment described, the core layer 11 is polyurethane foam with an ILD of 36, and a density of 1.8 lb/cf and these values may vary typically in a range of ±20%.

Figure 8:
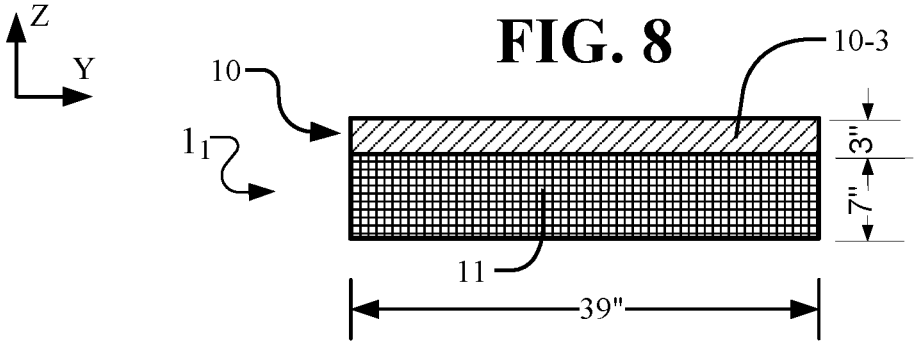
FIG. 8 depicts an end view of the mattress composite of FIG. 6 and FIG. 7.

In FIG. 8, an end view of a mattress composite $\mathbf{1}_1$ of FIG. 6 and FIG. 7 is shown in the YZ-plane. The mattress composite $\mathbf{1}_1$ includes layer 10 and shows the section 10-3 extending across the 39" width of the composite $\mathbf{1}_1$ in the Y-axis direction with a height of 3" in the Z-axis direction. The foam core layer 11 supports the layer 10 and extends across the 39" width of the composite $\mathbf{1}_1$ in the Y-axis direction with a height of 7" in the Z-axis direction.

Figure 9:
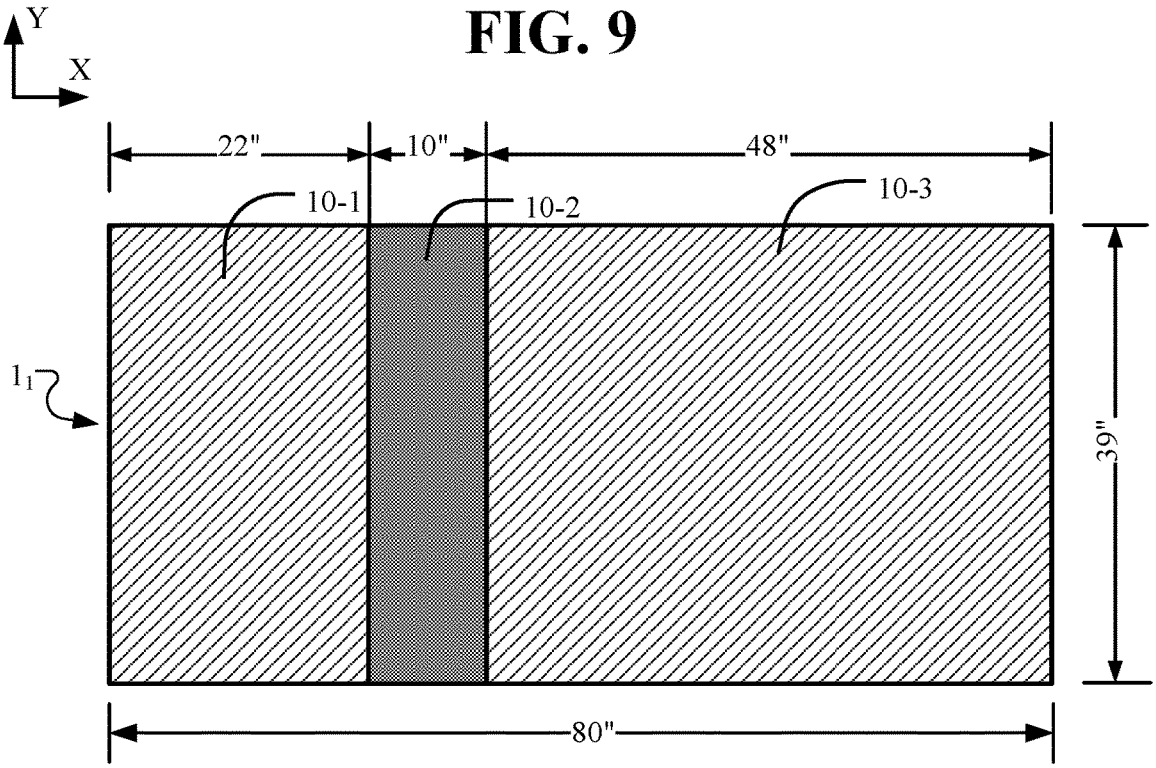
FIG. 9 depicts a top view of a mattress composite for a Twin Long size mattress.

In FIG. 9, a top view of a mattress composite $\mathbf{1}_1$ is shown in the XY-plane for a Twin Long size mattress 1-1 of the type shown in FIG. 1 and FIG. 2. The mattress composite $\mathbf{1}_1$ includes $1^{ST}$, $2^{ND}$ and $3^{RD}$ sections 10-1, 10-2 and 10-3, respectively, in the X-axis direction, each extending across in the Y-axis direction. The $1^{ST}$, $2^{ND}$ and $3^{RD}$ regions of the mattress composite $\mathbf{1}_1$ are for supporting a recumbent person where a person's recumbent body includes a head and shoulder part intended for the $1^{ST}$ region, a thoracic part intended for the $2^{ND}$ region and a hip part and a leg part intended for $3^{RD}$ region. A body reclining on a mattress having the composite $\mathbf{1}_1$ depresses portions of the sections 10-1, 10-2 and 10-3 in the vertical direction (Z-axis direction) normal to the XY plane (formed by the X-axis and the Y-axis). The $1^{ST}$, $2^{ND}$ and $3^{RD}$ sections 10-1, 10-2 and 10-3, respectively, in the X-axis direction each extend across the 39" width of the composite $\mathbf{1}_1$ in the Y-axis direction. In the X-action direction, the section 10-1 is 22", the section 10-2 is 10" and the section 10-3 is 48" whereby the composite $\mathbf{1}_1$ is 80" long in the X-axis direction.

Figure 10:
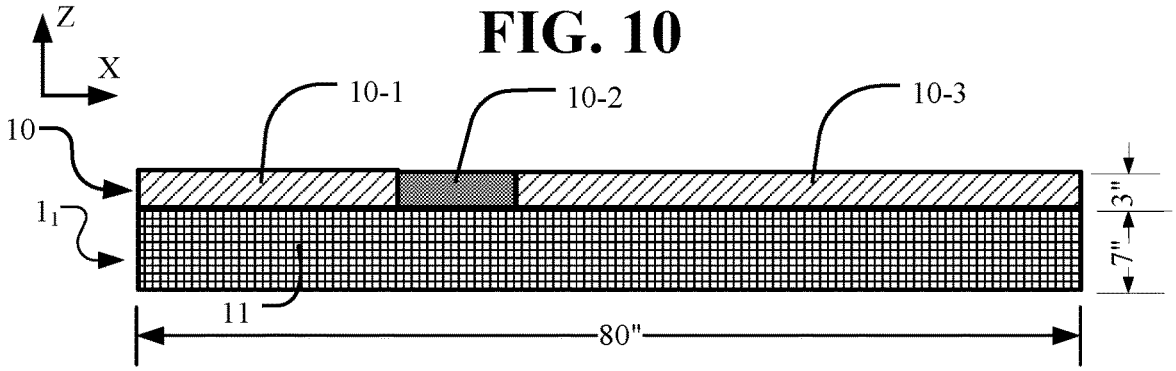
FIG. 10 depicts a front view of the mattress composite of FIG. 9.

In FIG. 10, a front view of a mattress composite $\mathbf{1}_1$ of FIG. 9 is shown in the XZ-plane. The mattress composite $\mathbf{1}_1$ includes layer 10 having $1^{ST}$, $2^{ND}$ and $3^{RD}$ sections 10-1, 10-2 and 10-3, respectively, in the X-axis direction, each extending across the 39" width of the composite $\mathbf{1}_1$ in the Y-axis direction. In the X-action direction, the section 10-1 is 22", the section 10-2 is 10" and the section 10-3 is 48". The layer 10 and each of the sections 10-1, 10-2 and 10-3 are 3" thick foam and are supported by a 7" foam core layer 11.

The layer 10 is the performance layer which in one preferred embodiment is 3" thick in the Z-axis direction. The thickness can vary and typically is between 2" and 4". In the embodiment described, the section 10-1, for the head and shoulder region, is polyurethane foam with an ILD of 18, and a density of 2.0 lb/cf. In the embodiment described, the section 10-2, for the thoracic region, is polyurethane foam with an ILD of 27, and a density of 2.0 lb/cf. In the embodiment described, the section 10-3, for the hip and leg region, is polyurethane foam with an ILD of 23, and a density of 2.0 lb/cf. While the ILD's and densities are preferred for one embodiment described, these values may be different typically in a range of ±20%. While polyurethane foam is used in one particular embodiment, latex and other foams are also employed in other embodiments.

In the performance layer 10, the thoracic section 10-2 is more firm than the head and shoulder section 10-1 and the hip and leg section 10-3. With this relationship, the head and shoulder section 10-1 and the hip and leg section 10-3 are able to depress in the Z-axis direction greater than the depression of the thoracic section 10-2. This relationship helps to establish proper alignment of the recumbent body.

The core layer 11 is the base layer, for supporting the performance layer 10, and in one preferred embodiment is 7" thick in the Z-axis direction. The thickness can vary and typically is between 6" and 10". In the embodiment described, the core layer 11 is polyurethane foam with an ILD of 36, and a density of 1.8 lb/cf and these values may vary typically in a range of ±20%.

Figure 11:
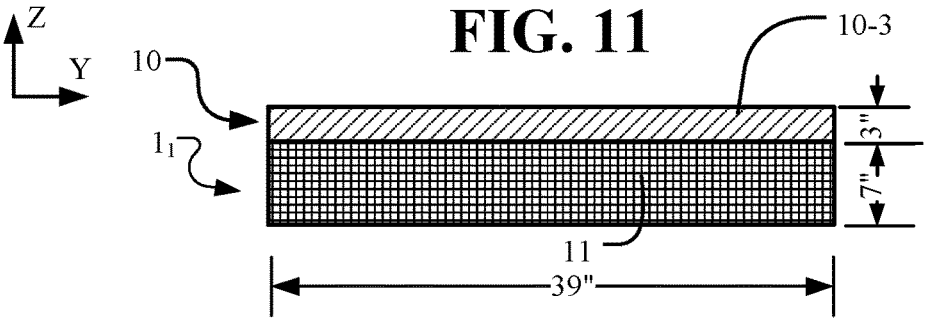
FIG. 11 depicts an end view of the mattress composite of FIG. 9 and FIG. 10.

In FIG. 11, an end view of a mattress composite $\mathbf{1}_1$ of FIG. 9 and FIG. 10 is shown in the YZ-plane. The mattress composite $\mathbf{1}_1$ includes layer 10 and shows the section 10-3 extending across the 39" width of the composite $\mathbf{1}_1$ in the Y-axis direction with a height of 3" in the Z-axis direction. The foam core layer 11 supports the layer 10 and extends across the 39" width of the composite $\mathbf{1}_1$ in the Y-axis direction with a height of 7" in the Z-axis direction.

Figure 12:
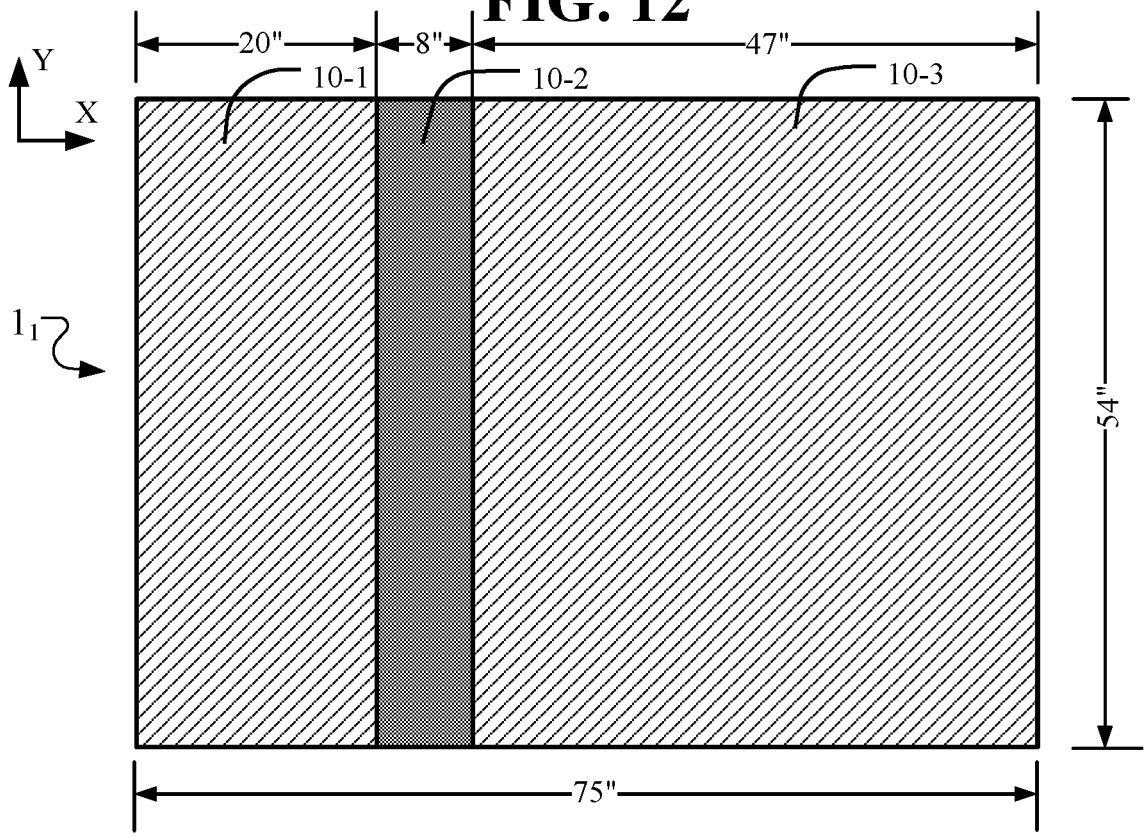
FIG. 12 depicts a top view of a mattress composite for a Full size mattress.

In FIG. 12, a top view of a mattress composite $\mathbf{1}_1$ is shown in the XY-plane for a Twin Long size mattress 1-1 of the type shown in FIG. 1 and FIG. 2. The mattress composite includes $1^{ST}$, $2^{ND}$ and $3^{RD}$ sections 10-1, 10-2 and 10-3, respectively, in the X-axis direction, each extending across in the Y-axis direction. The $1^{ST}$, $2^{ND}$ and $3^{RD}$ regions of the mattress composite are for supporting a recumbent person where a person's recumbent body includes a head and shoulder part intended for the $1^{ST}$ region, a thoracic part intended for the $2^{ND}$ region and a hip part and a leg part intended for $3^{RD}$ region. A body reclining on a mattress having the composite depresses portions of the sections 10-1, 10-2 and 10-3 in the vertical direction (Z-axis direction) normal to the XY plane (formed by the X-axis and the Y-axis). The $1^{ST}$, $2^{ND}$ and $3^{RD}$ sections 10-1, 10-2 and 10-3, respectively, in the X-axis direction each extend across the 54" width of the composite $\mathbf{1}_1$ in the Y-axis direction. In the X-action direction, the section 10-1 is 20", the section 10-2 is 8" and the section 10-3 is 47" whereby the composite $\mathbf{1}_1$ is 75" long in the X-axis direction.

Figure 13:
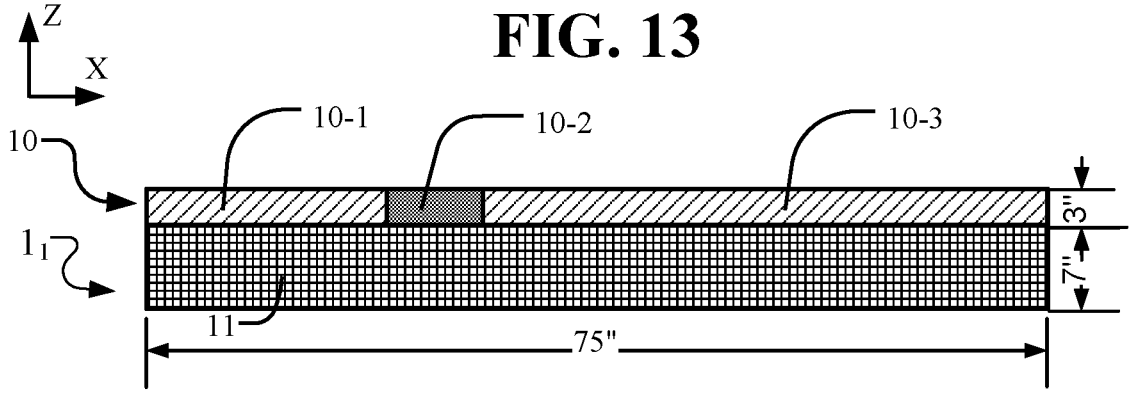
FIG. 13 depicts a front view of the mattress composite of FIG. 12.

In FIG. 13, a front view of a mattress composite $\mathbf{1}_1$ of FIG. 12 is shown in the XZ-plane. The mattress composite $\mathbf{1}_1$ includes layer 10 having $1^{ST}$, $2^{ND}$ and $3^{RD}$ sections 10-1, 10-2 and 10-3, respectively, in the X-axis direction, each extending across the 54" width of the composite $\mathbf{1}_1$ in the Y-axis direction. In the X-action direction, the section 10-1 is 20", the section 10-2 is 8" and the section 10-3 is 47". The layer 10 and each of the sections 10-1, 10-2 and 10-3 are 3" thick foam and are supported by a 7" foam core layer 11.

The layer 10 is the performance layer which in one preferred embodiment is 3" thick in the Z-axis direction. The thickness can vary and typically is between 2" and 4". In the embodiment described, the section 10-1, for the head and shoulder region, is polyurethane foam with an ILD of 18, and a density of 2 lb/cf. In the embodiment described, the section 10-2, for the thoracic region, is polyurethane foam with an ILD of 27, and a density of 2 lb/cf. In the embodiment described, the section 10-3, for the hip and leg region, is polyurethane foam with an ILD of 23, and a density of 2 lb/cf. While the ILD's and densities are preferred for one embodiment described, these values may be different typically in a range of ±20%. While polyurethane foam is used in one particular embodiment, latex and other foams are also employed in other embodiments.

In the performance layer 10, the thoracic section 10-2 is more firm than the head and shoulder section 10-1 and the hip and leg section 10-3. With this relationship, the head and shoulder section 10-1 and the hip and leg section 10-3 are able to depress in the Z-axis direction greater than the depression of the thoracic section 10-2. This relationship helps to establish proper alignment of the recumbent body.

The core layer 11 is the base layer, for supporting the performance layer 10, and in one preferred embodiment is 7" thick in the Z-axis direction. The thickness can vary and typically is between 6" and 10". In the embodiment described, the core layer 11 is polyurethane foam with an ILD of 36, and a density of 1.8 lb/cf and these values may vary typically in a range of ±20%.

Figure 14:
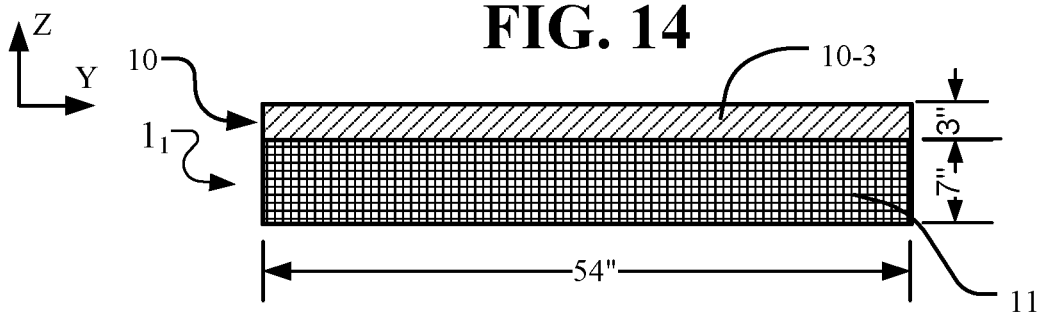
FIG. 14 depicts an end view of the mattress composite of FIG. 12 and FIG. 13.

In FIG. 14, an end view of a mattress composite $\mathbf{1}_1$ of FIG. 12 and FIG. 13 is shown in the YZ-plane. The mattress composite $\mathbf{1}_1$ includes layer 10 and shows the section 10-3 extending across the 39" width of the composite $\mathbf{1}_1$ in the Y-axis direction with a height of 3" in the Z-axis direction. The foam core layer 11 supports the layer 10 and extends across the 54" width of the composite $\mathbf{1}_1$ in the Y-axis direction with a height of 7" in the Z-axis direction.

Figure 15:
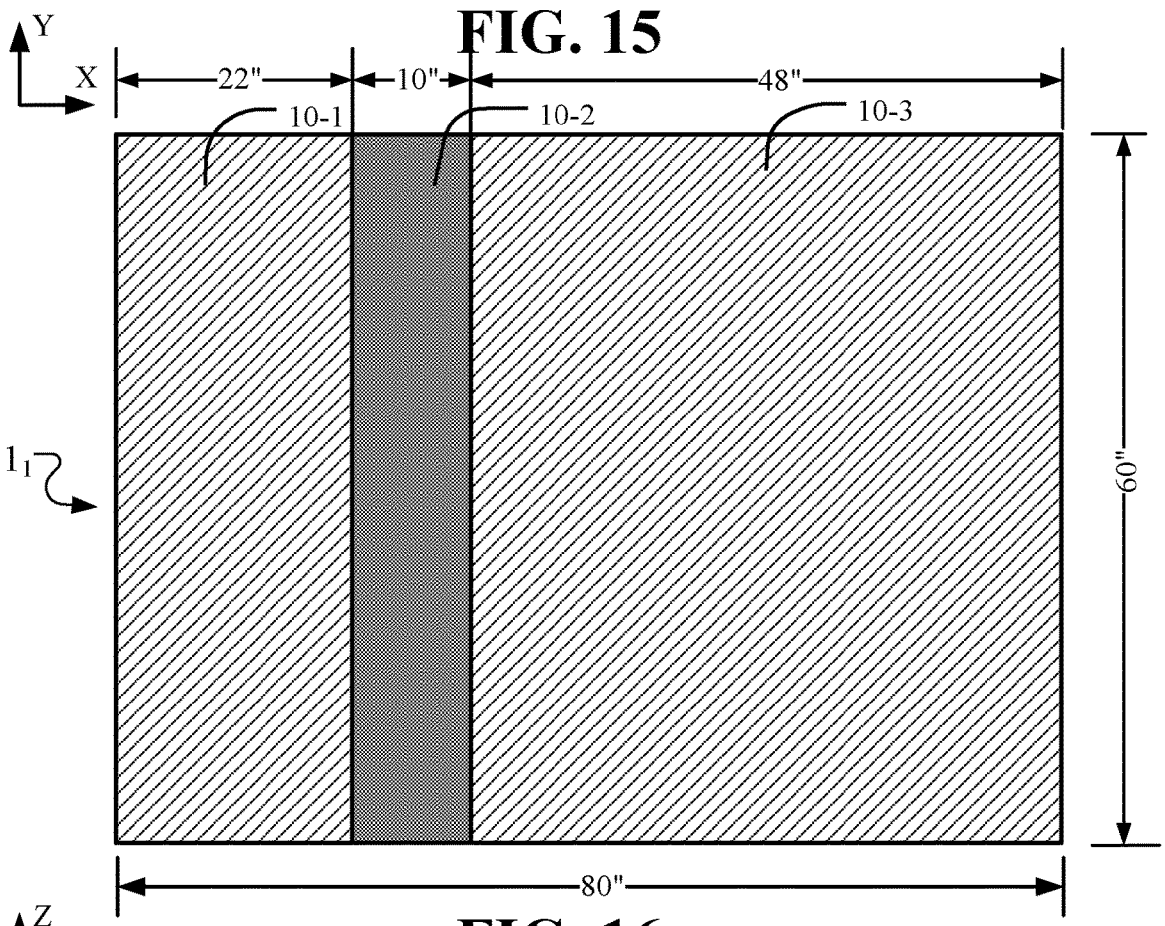
FIG. 15 depicts a top view of a mattress composite for a Queen mattress.

In FIG. 15, a top view of a mattress composite $\mathbf{1}_1$ is shown in the XY-plane for a Queen size mattress 1-1 of the type shown in FIG. 1 and FIG. 2. The mattress composite $\mathbf{1}_1$ includes $1^{ST}$, $2^{ND}$ and $3^{RD}$ sections 10-1, 10-2 and 10-3, respectively, in the X-axis direction, each extending across in the Y-axis direction. The $1^{ST}$, $2^{ND}$ and $3^{RD}$ regions of the mattress composite $\mathbf{1}_1$ are for supporting a recumbent person where a person's recumbent body includes a head and shoulder part intended for the $1^{ST}$ region, a thoracic part intended for the $2^{ND}$ region and a hip part and a leg part intended for $3^{RD}$ region. A body reclining on a mattress having the composite $\mathbf{1}_1$ depresses portions of the sections 10-1, 10-2 and 10-3 in the vertical direction (Z-axis direction) normal to the XY plane (formed by the X-axis and the Y-axis). The $1^{ST}$, $2^{ND}$ and $3^{RD}$ sections 10-1, 10-2 and 10-3, respectively, in the X-axis direction each extend across the 60" width of the composite $\mathbf{1}_1$ in the Y-axis direction. In the X-action direction, the section 10-1 is 22", the section 10-2 is 10" and the section 10-3 is 48" whereby the composite $\mathbf{1}_1$ is 80" long in the X-axis direction.

Figure 16:
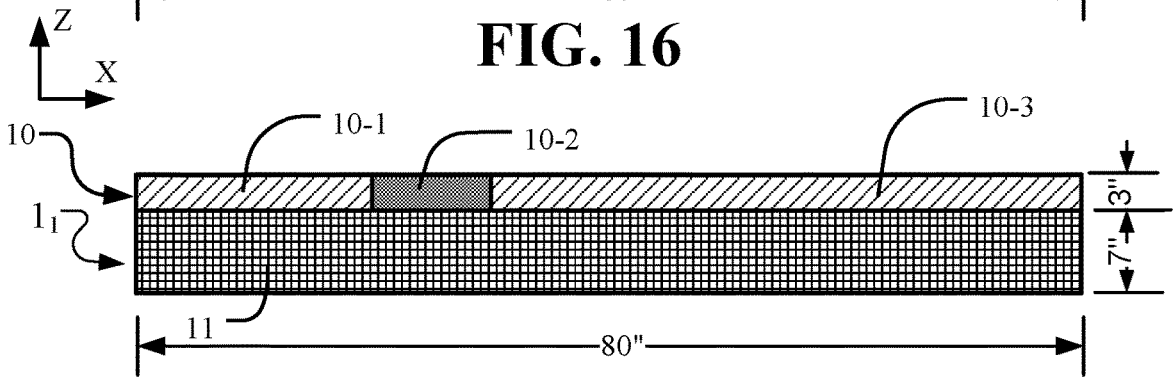
FIG. 16 depicts a front view of the mattress composite of FIG. 15.

In FIG. 16, a front view of a mattress composite $\mathbf{1}_1$ of FIG. 15 is shown in the XZ-plane. The mattress composite $\mathbf{1}_1$ includes layer 10 having $1^{ST}$, $2^{ND}$ and $3^{RD}$ sections 10-1, 10-2 and 10-3, respectively, in the X-axis direction, each extending across the 60" width of the composite $\mathbf{1}_1$ in the Y-axis direction. In the X-action direction, the section 10-1 is 22", the section 10-2 is 10" and the section 10-3 is 48". The layer 10 and each of the sections 10-1, 10-2 and 10-3 are 3" thick foam and are supported by a 7" foam core layer 11.

The layer 10 is the performance layer which in one preferred embodiment is 3" thick in the Z-axis direction. The thickness can vary and typically is between 2" and 4". In the embodiment described, the section 10-1, for the head and shoulder region, is polyurethane foam with an ILD of 18, and a density of 2 lb/cf. In the embodiment described, the section 10-2, for the thoracic region, is polyurethane foam with an ILD of 27, and a density of 2 lb/cf. In the embodiment described, the section 10-3, for the hip and leg region, is polyurethane foam with an ILD of 23, and a density of 2 lb/cf. While the ILD's and densities are preferred for one embodiment described, these values may be different typically in a range of ±20%. While polyurethane foam is used in one particular embodiment, latex and other foams are also employed in other embodiments.

In the performance layer 10, the thoracic section 10-2 is more firm than the head and shoulder section 10-1 and the hip and leg section 10-3. With this relationship, the head and shoulder section 10-1 and the hip and leg section 10-3 are able to depress in the Z-axis direction greater than the depression of the thoracic section 10-2. This relationship helps to establish proper alignment of the recumbent body.

The core layer 11 is the base layer, for supporting the performance layer 10, and in one preferred embodiment is 7" thick in the Z-axis direction. The thickness can vary and typically is between 6" and 10". In the embodiment described, the core layer 11 is polyurethane foam with an ILD of 36, and a density of 1.8 lb/cf and these values may vary typically in a range of ±20%.

Figure 17:
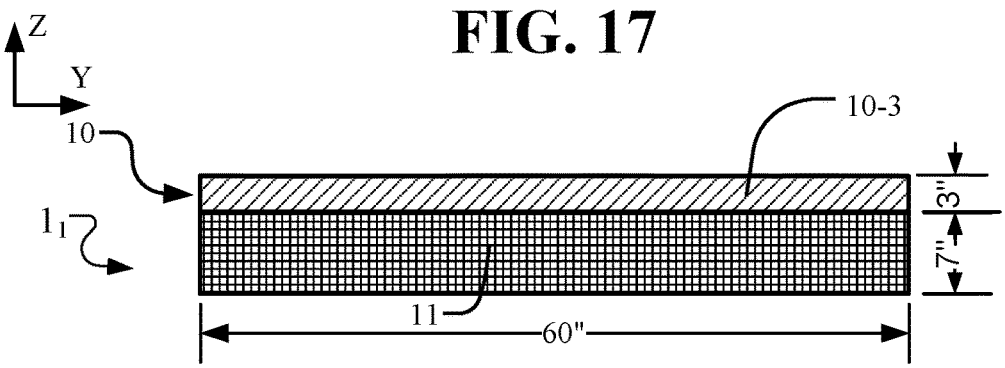
FIG. 17 depicts an end view of the mattress composite of FIG. 15 and FIG. 16.

In FIG. 17, an end view of a mattress composite $\mathbf{1}_1$ of FIG. 15 and FIG. 16 is shown in the YZ-plane. The mattress composite $\mathbf{1}_1$ includes layer 10 and shows the section 10-3 extending across the 60" width of the composite $\mathbf{1}_1$ in the Y-axis direction with a height of 3" in the Z-axis direction. The foam core layer 11 supports the layer 10 and extends across the 60" width of the composite $\mathbf{1}_1$ in the Y-axis direction with a height of 7" in the Z-axis direction.

Figure 18:
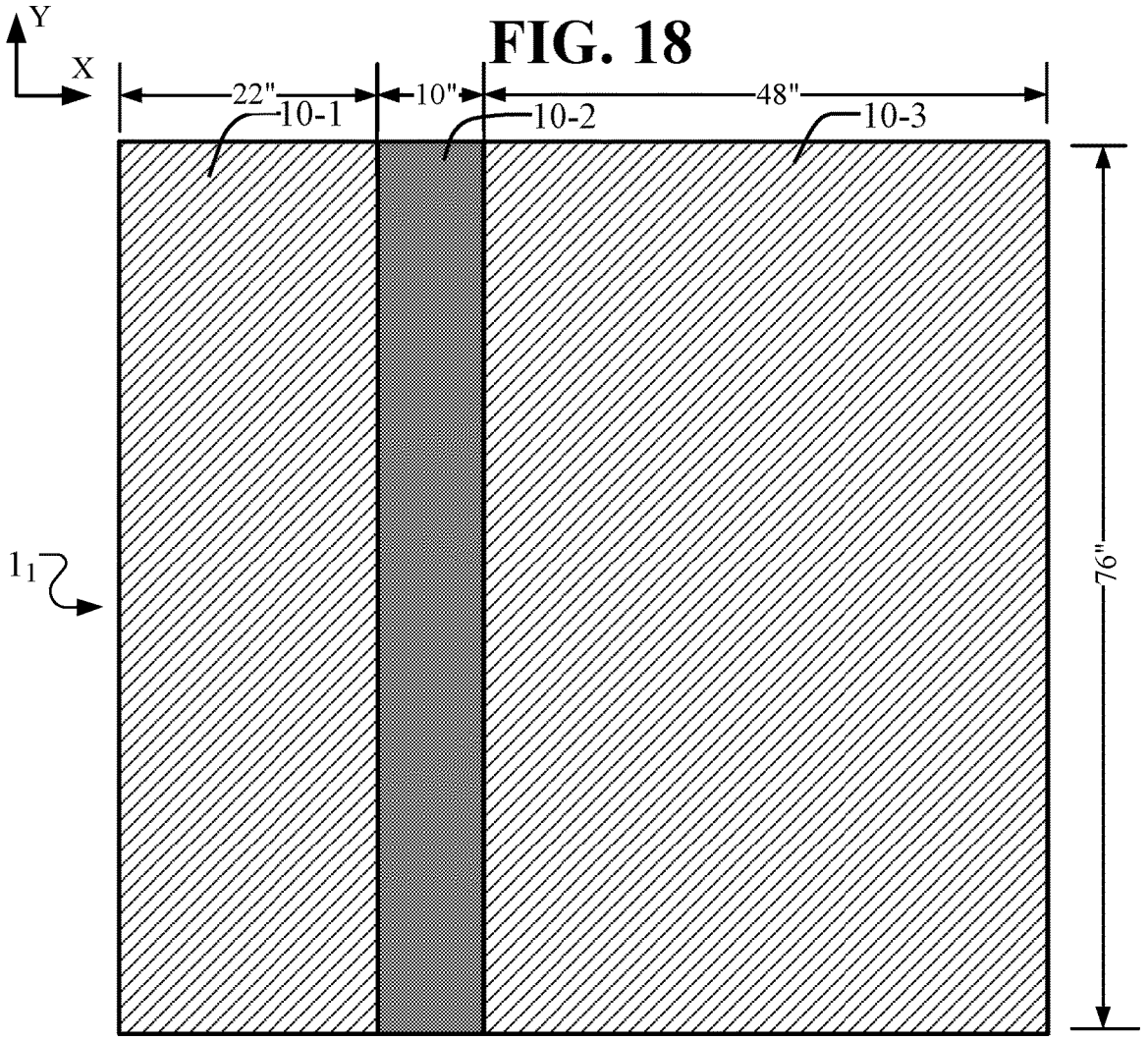
FIG. 18 depicts a top view of a mattress composite for an Eastern King mattress.

In FIG. 18, a top view of a mattress composite $\mathbf{1}_1$ is shown in the XY-plane for an Eastern King size mattress 1-1 of the type shown in FIG. 1 and FIG. 2. The mattress composite $\mathbf{1}_1$ includes $1^{ST}$, $2^{ND}$ and $3^{RD}$ sections 10-1, 10-2 and 10-3, respectively, in the X-axis direction, each extending across in the Y-axis direction. The $1^{ST}$, $2^{ND}$ and $3^{RD}$ regions of the mattress composite are for supporting a recumbent person where a person's recumbent body includes a head and shoulder part intended for the $1^{ST}$ region, a thoracic part intended for the $2^{ND}$ region and a hip part and a leg part intended for $3^{RD}$ region. A body reclining on a mattress having the composite depresses portions of the sections 10-1, 10-2 and 10-3 in the vertical direction (Z-axis direction) normal to the XY plane (formed by the X-axis and the Y-axis). The $1^{ST}$, $2^{ND}$ and $3^{RD}$ sections 10-1, 10-2 and 10-3, respectively, in the X-axis direction each extend across the 76" width of the composite $\mathbf{1}_1$ in the Y-axis direction. In the X-action direction, the section 10-1 is 22", the section 10-2 is 10" and the section 10-3 is 48" whereby the composite $\mathbf{1}_1$ is 80" long in the X-axis direction.

Figure 19:
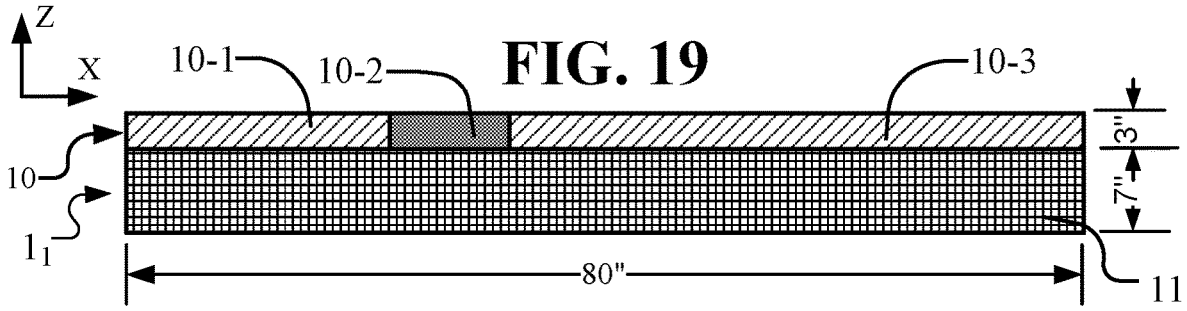
FIG. 19 depicts a front view of the mattress composite of FIG. 18.

In FIG. 19, a front view of a mattress composite $\mathbf{1}_1$ of FIG. 18 is shown in the XZ-plane. The mattress composite $\mathbf{1}_1$ includes layer 10 having $1^{ST}$, $2^{ND}$ and $3^{RD}$ sections 10-1, 10-2 and 10-3, respectively, in the X-axis direction, each extending across the 76" width of the composite $\mathbf{1}_1$ in the Y-axis direction. In the X-action direction, the section 10-1 is 22", the section 10-2 is 10" and the section 10-3 is 48". The layer 10 and each of the sections 10-1, 10-2 and 10-3 are 3" thick foam and are supported by a 7" foam core layer 11.

The layer 10 is the performance layer which in one preferred embodiment is 3" thick in the Z-axis direction. The thickness can vary and typically is between 2" and 4". In the embodiment described, the section 10-1, for the head and shoulder region, is polyurethane foam with an ILD of 18, and a density of 2 lb/cf. In the embodiment described, the section 10-2, for the thoracic region, is polyurethane foam with an ILD of 27, and a density of 2 lb/cf. In the embodiment described, the section 10-3, for the hip and leg region, is polyurethane foam with an ILD of 23, and a density of 2 lb/cf. While the ILD's and densities are preferred for one embodiment described, these values may be different typically in a range of ±20%. While polyurethane foam is used in one particular embodiment, latex and other foams are also employed in other embodiments.

In the performance layer 10, the thoracic section 10-2 is more firm than the head and shoulder section 10-1 and the hip and leg section 10-3. With this relationship, the head and shoulder section 10-1 and the hip and leg section 10-3 are able to depress in the Z-axis direction greater than the depression of the thoracic section 10-2. This relationship helps to establish proper alignment of the recumbent body.

The core layer 11 is the base layer, for supporting the performance layer 10, and in one preferred embodiment is 7" thick in the Z-axis direction. The thickness can vary and typically is between 6" and 10". In the embodiment described, the core layer 11 is polyurethane foam with an ILD of 36, and a density of 1.8 lb/cf and these values may vary typically in a range of ±20%.

Figure 20:
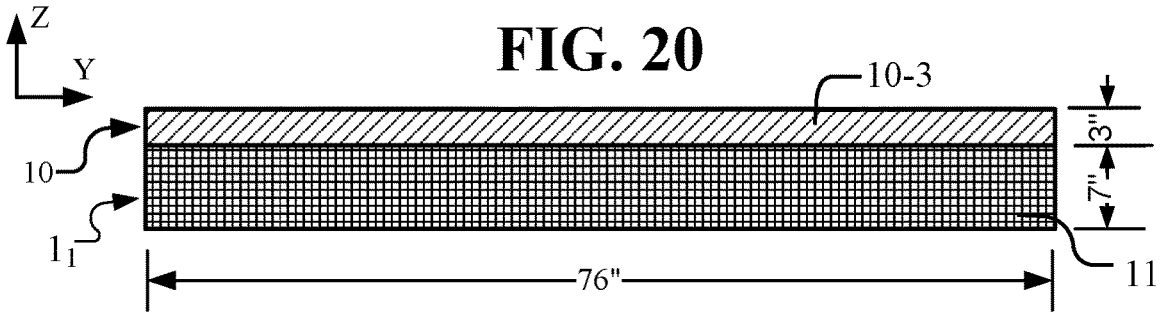
FIG. 20 depicts an end view of the mattress composite of FIG. 18 and FIG. 19.

In FIG. 20, an end view of a mattress composite $\mathbf{1}_1$ of FIG. 18 and FIG. 19 is shown in the YZ-plane. The mattress composite $\mathbf{1}_1$ includes layer 10 and shows the section 10-3 extending across the 76" width of the composite $\mathbf{1}_1$ in the Y-axis direction with a height of 3" in the Z-axis direction. The foam core layer 11 supports the layer 10 and extends across the 76" width of the composite $\mathbf{1}_1$ in the Y-axis direction with a height of 7" in the Z-axis direction.

Figure 21:
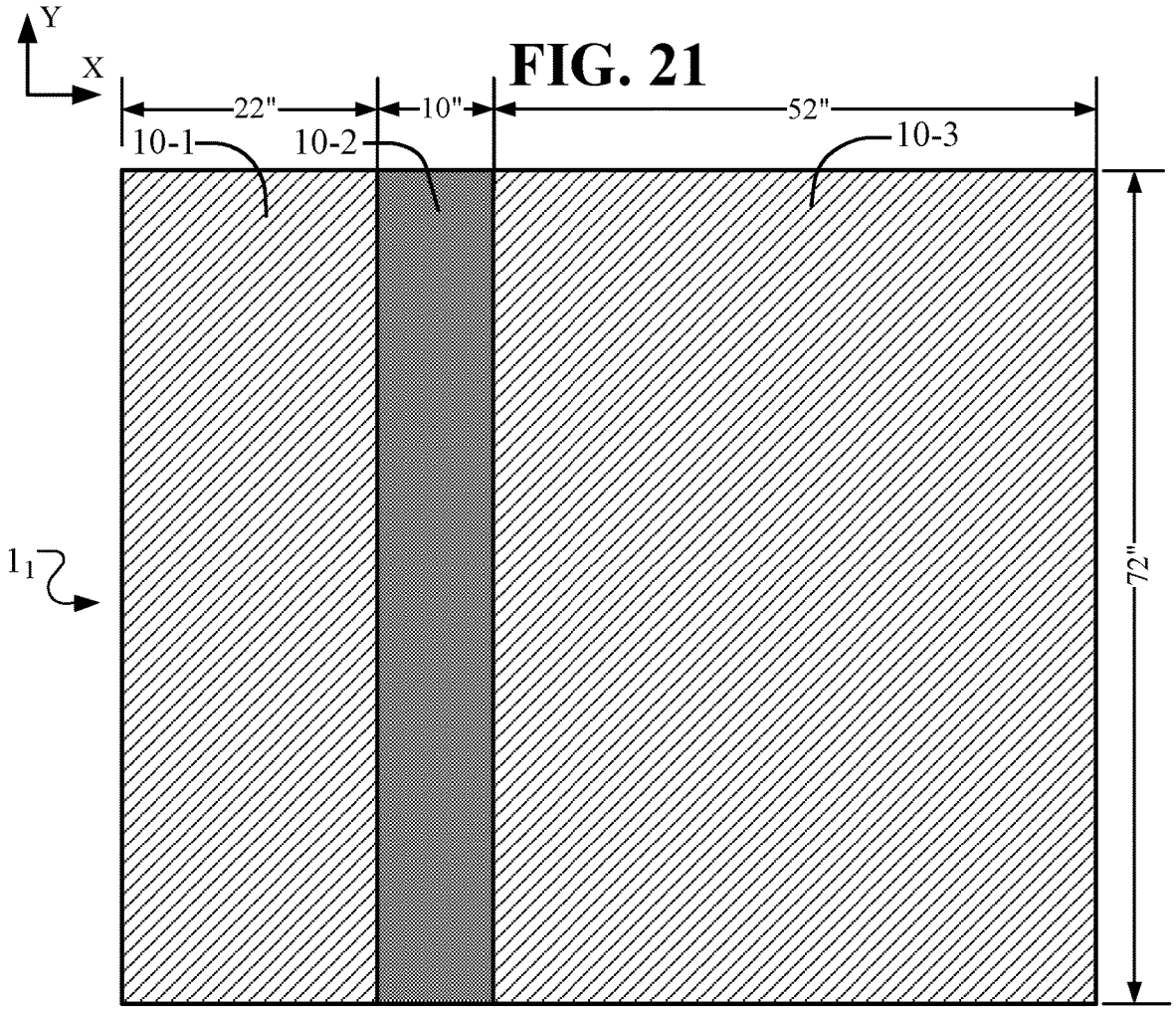
FIG. 21 depicts a top view of a mattress composite for a California King mattress.

In FIG. 21, a top view of a mattress composite $\mathbf{1}_1$ is shown in the XY-plane for a California King size mattress 1-1 of the type shown in FIG. 1 and FIG. 2. The mattress composite 1" includes $1^{ST}$, $2^{ND}$ and $3^{RD}$ sections 10-1, 10-2 and 10-3, respectively, in the X-axis direction, each extending across in the Y-axis direction. The $1^{ST}$, $2^{ND}$ and $3^{RD}$ regions of the mattress composite $\mathbf{1}_1$ are for supporting a recumbent person where a person's recumbent body includes a head and shoulder part intended for the $1^{ST}$ region, a thoracic part intended for the $2^{ND}$ region and a hip part and a leg part intended for $3^{RD}$ region. A body reclining on a mattress having the composite $\mathbf{1}_1$ depresses portions of the sections 10-1, 10-2 and 10-3 in the vertical direction (Z-axis direction) normal to the XY plane (formed by the X-axis and the Y-axis). The $1^{ST}$, $2^{ND}$ and $3^{RD}$ sections 10-1, 10-2 and 10-3, respectively, in the X-axis direction each extend across the 72" width of the composite $\mathbf{1}_1$ in the Y-axis direction. In the X-action direction, the section 10-1 is 22", the section 10-2 is 10" and the section 10-3 is 52" whereby the composite $\mathbf{1}_1$ is 84" long in the X-axis direction.

Figure 22:
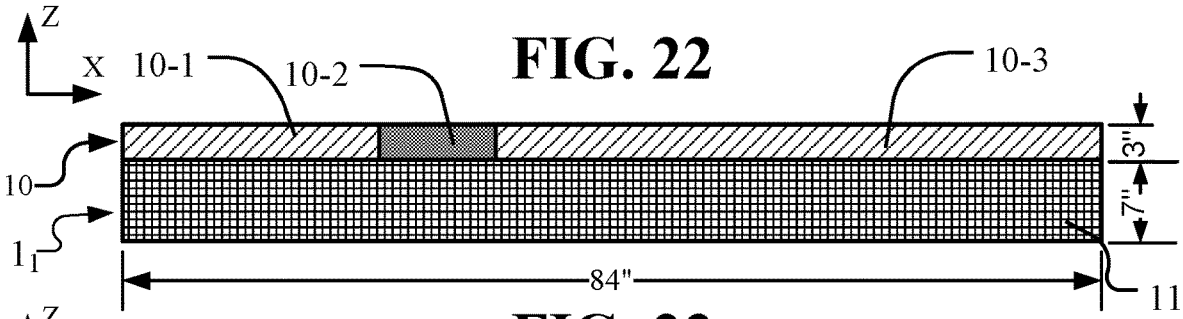
FIG. 22 depicts a front view of the mattress composite of FIG. 21.

In FIG. 22, a front view of a mattress composite $\mathbf{1}_1$ of FIG. 21 is shown in the XZ-plane. The mattress composite $\mathbf{1}_1$ includes layer 10 having $1^{ST}$, $2^{ND}$ and $3^{RD}$ sections 10-1, 10-2 and 10-3, respectively, in the X-axis direction, each extending across the 72" width of the composite $\mathbf{1}_1$ in the Y-axis direction. In the X-action direction, the section 10-1 is 22", the section 10-2 is 10" and the section 10-3 is 52". The layer 10 and each of the sections 10-1, 10-2 and 10-3 are 3" thick foam and are supported by a 7" foam core layer 11.

The layer 10 is the performance layer which in one preferred embodiment is 3" thick in the Z-axis direction. The thickness can vary and typically is between 2" and 4". In the embodiment described, the section 10-1, for the head and shoulder region, is polyurethane foam with an ILD of 18, and a density of 2 lb/cf. In the embodiment described, the section 10-2, for the thoracic region, is polyurethane foam with an ILD of 27, and a density of 2 lb/cf. In the embodiment described, the section 10-3, for the hip and leg region, is polyurethane foam with an ILD of 23, and a density of 2 lb/cf. While the ILD's and densities are preferred for one embodiment described, these values may be different typically in a range of ±20%. While polyurethane foam is used in one particular embodiment, latex and other foams are also employed in other embodiments.

In the performance layer 10, the thoracic section 10-2 is more firm than the head and shoulder section 10-1 and the hip and leg section 10-3. With this relationship, the head and shoulder section 10-1 and the hip and leg section 10-3 are able to depress in the Z-axis direction greater than the depression of the thoracic section 10-2. This relationship helps to establish proper alignment of the recumbent body.

The core layer 11 is the base layer, for supporting the performance layer 10, and in one preferred embodiment is 7" thick in the Z-axis direction. The thickness can vary and typically is between 6" and 10". In the embodiment described, the core layer 11 is polyurethane foam with an ILD of 36, and a density of 1.8 lb/cf and these values may vary typically in a range of ±20%.

Figure 23:
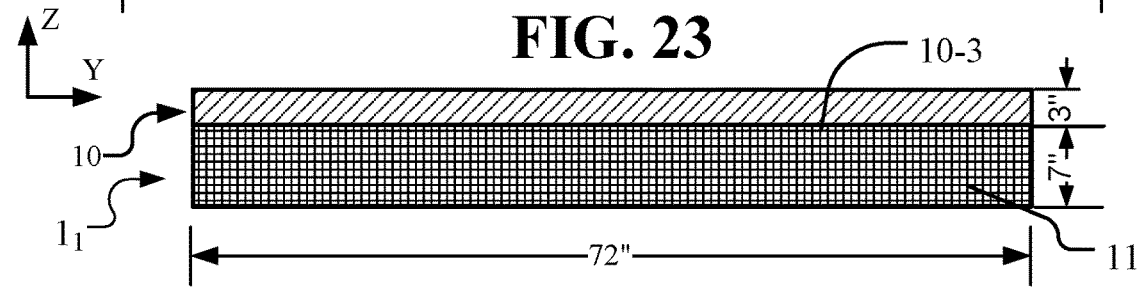
FIG. 23 depicts an end view of the mattress composite of FIG. 21 and FIG. 22.

In FIG. 23, an end view of a mattress composite $\mathbf{1}_1$ of FIG. 21 and FIG. 22 is shown in the YZ-plane. The mattress composite $\mathbf{1}_1$ includes layer 10 and shows the section 10-3 extending across the 72" width of the composite $\mathbf{1}_1$ in the Y-axis direction with a height of 3" in the Z-axis direction. The foam core layer 11 supports the layer 10 and extends across the 72" width of the composite $\mathbf{1}_1$ in the Y-axis direction with a height of 7" in the Z-axis direction.

Figure 24:
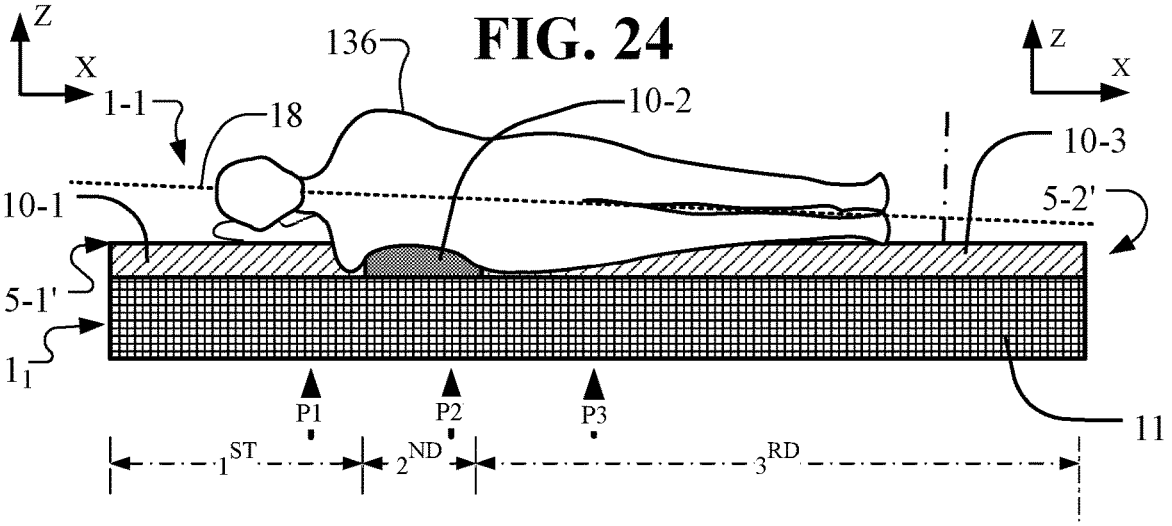
FIG. 24 depicts a side lying female recumbent body on a mattress composite.

In FIG. 24, a side lying female recumbent body 136 is supported on a mattress composite $\mathbf{1}_1$ of the FIG. 1 and FIG. 2 type. The female body 136 is recumbent on her side parallel to the XZ-plane (sagittal plane). The body 136 is in alignment as indicated by the axis 18 which is generally straight through the body 136. The axis 18 is slightly inclined (for example, approximately 2 degrees) relative to the XY-plane with the axis 18 near the head slightly elevated relative to the axis 18 near the legs. The composite $\mathbf{1}_1$ has varying displacement parameters that function to support a recumbent body 136 with low body pressure and alignment.

In FIG. 24, the composite $\mathbf{1}_1$ has $1^{ST}$, $2^{ND}$ and $3^{RD}$ regions that receive body pressures P1, P2 and P3, respectively. The $1^{ST}$ region extends to the head of the mattress 5-1' and is located beneath the head and shoulder parts of a body 136. The shoulder part of a body 136 at one location exerts a pressure P1 against the composite $\mathbf{1}_1$. The $2^{ND}$ region is located beneath the thoracic part of a body 136 and at one point exerts a pressure P2 against the composite $\mathbf{1}_1$. The $3^{RD}$ region is located beneath the hip part of the body 136 in the trochanter region 19 and exerts pressure P3 against the composite $\mathbf{1}_1$. The varying displacement parameters of the composite $\mathbf{1}_1$ function to support the recumbent body 136 with low body pressure and alignment.

Figure 25:
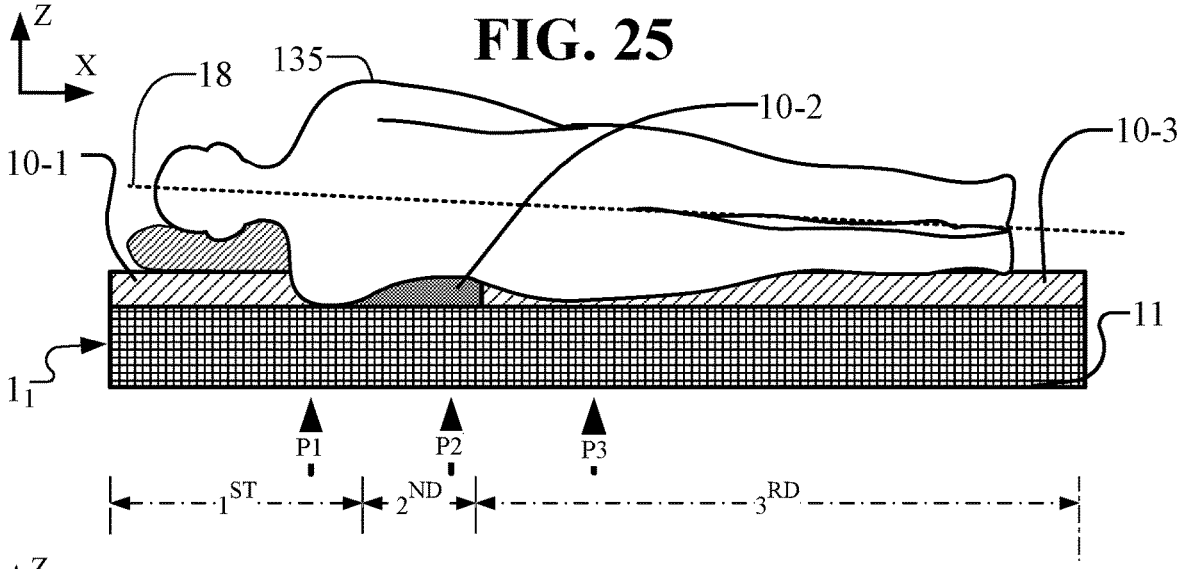
FIG. 25 depicts a side lying male recumbent body on a mattress composite.

In FIG. 25, a side lying male recumbent body 135 is supported on a mattress composite $\mathbf{1}_1$ of the FIG. 1 and FIG. 2 type. The male body 135 is recumbent on his side parallel to the XZ-plane (sagittal plane). The body 135 is in alignment as indicated by the axis 18 which is generally straight through the body 135. The axis 18 is slightly inclined (for example, approximately 2 degrees) relative to the XY-plane with the axis 18 near the head slightly elevated relative to the axis 18 near the legs. The composite $\mathbf{1}_1$ has varying displacement parameters that function to support the recumbent body 135 with low body pressure and alignment.

In FIG. 25, the composite $\mathbf{1}_1$ has $1^{ST}$, $2^{ND}$ and $3^{RD}$ regions that receive body pressures P1, P2 and P3, respectively. The $1^{ST}$ region extends to the head of the mattress 5-1' and is located beneath the head and shoulder parts of a body 135. The shoulder part of a body 135 at one location exerts a pressure P1 against the composite $1_1$. The $2^{ND}$ region is located beneath the thoracic part of the body 135 and at one point exerts a pressure P2 against the composite $1_1$. The $3^{RD}$ region is located beneath the hip part of the body 136 in the trochanter region 19 and exerts pressure P3 against the composite $1_1$. The varying displacement parameters of the composite $1_1$ function to support the recumbent body 135 with low body pressure and alignment.

Figure 26:
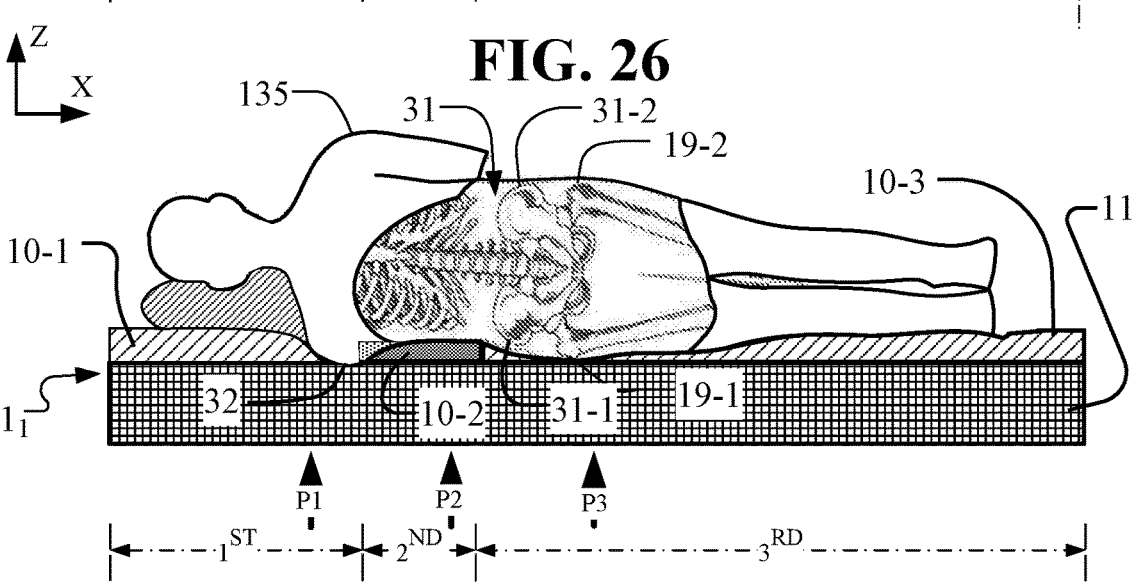
FIG. 26 depicts the side lying male recumbent body on a mattress composite of FIG. 25 with a cutaway to show the skeleton of the body.

In FIG. 26, the side lying male recumbent body 135 of FIG. 25 is shown with a partial cutaway to reveal the skeleton of the body. In FIG. 25, the composite $1_1$ has $1^{ST}$, $2^{ND}$ and $3^{RD}$ regions that receive body pressures P1, P2 and P3, respectively. The $1^{ST}$ region extends to the head of the mattress 5-1' and is located beneath the head and shoulder parts of a body 135. The shoulder part of a body 135 at one location exerts a pressure P1 against the composite $1_1$. The $2^{ND}$ region is located beneath the thoracic part of the body 135 and at one point exerts a pressure P2 against the composite $1_1$. The $3^{RD}$ region is located beneath the hip part of the body 136 in the pelvic girdle region 31 including the iliac crests 31-1 and 31-2 and the greater trochanter of the femur regions 19-1 and 19-2. The pressure P3 is exerted against the composite $1_1$ in the pelvic girdle region 31. The varying displacement parameters of the composite $1_1$ function to support the recumbent body 135 with low body pressure and alignment.

Figure 27:
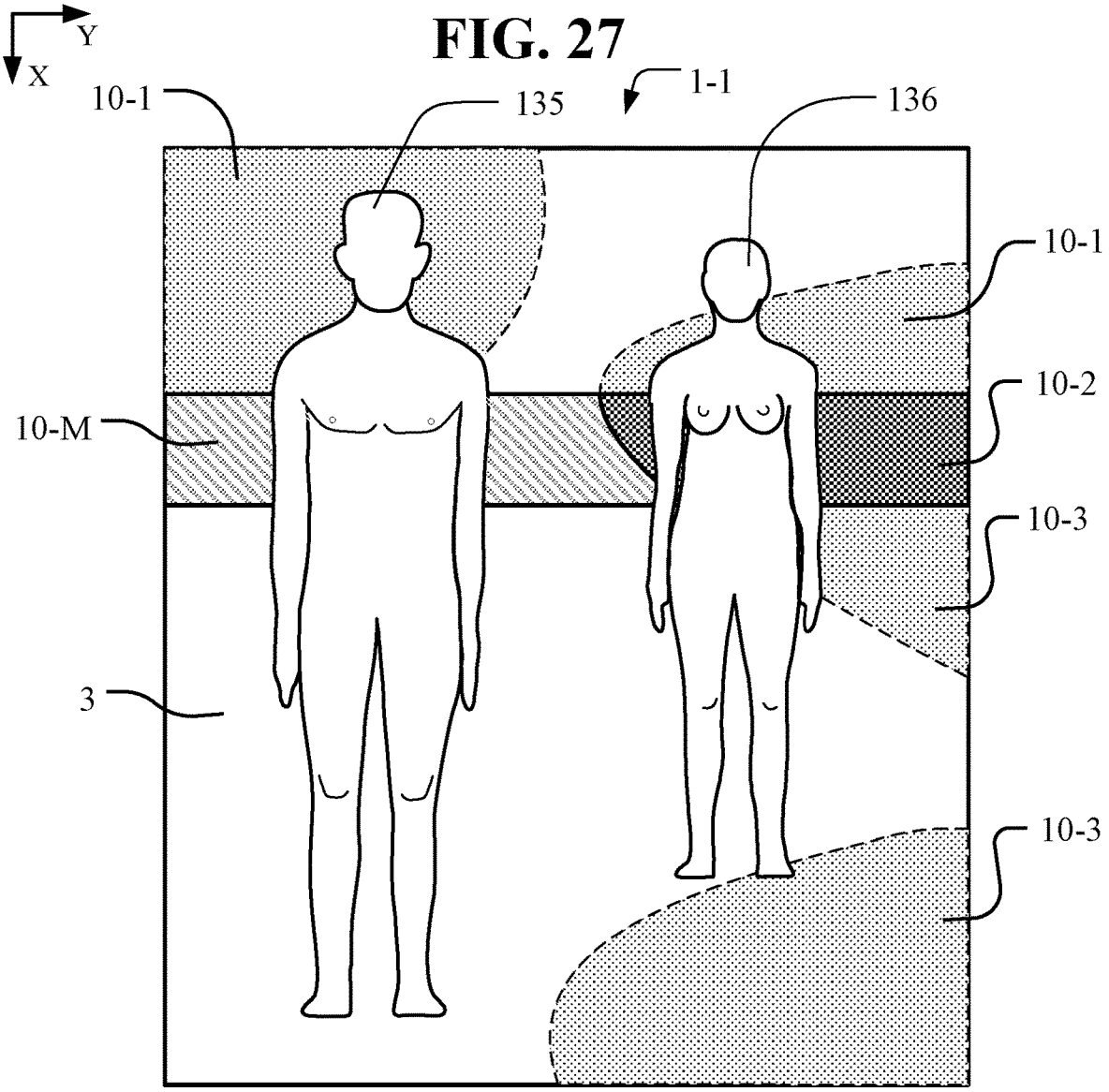
FIG. 27 depicts side by side male and female bodies on a mattress with cutaway views of the mattress cover.

In FIG. 26, the thoracic section 10-2 of the performance layer 10 is located above the pelvic girdle region 31 and extends toward the head and terminates near the shoulder region 32. In order for a body to be properly located on the mattress relative to the thoracic section 10-2 of the performance layer 10, the difference in hardness can be felt by a hand or other part of the body. Also, the glue seem between section 10-2 and 10-3 is manufacture to leave a small glue bead extending across the width of the mattress that provides a tactile indication of the location of the thoracic region of the performance layer.

the thoracic section and the hip section for providing a tactile indication of the location of the thoracic region of the performance layer, In FIG. 27, a partially cutaway top view of one embodiment of the mattress 1-1 of FIG. 1 and FIG. 2 is shown with a female body 136 on her back on the right and a male body 135 on his back on the left. The mattress 1-1 is the same type as described generally in connection with FIG. 1 through FIG. 23. In FIG. 27, a partially cutaway top view of parts of the mattress 1-1 of FIG. 1 are shown. The foam sections 10-1, 10-2 and 10-3 function to divide the mattress 1-1 into $1^{ST}$, $2^{ND}$ and $3^{RD}$ regions as described in connection with FIG. 1 and FIG. 23. The foam sections 10-1, 10-2 and 10-3 superimposed on foam member 11 (see FIG. 1) have varying displacement parameters that function to support the recumbent bodies 135 and 136 with low body pressure and alignment. In one embodiment when mattress 1-1 is a queen size, the length in the X-axis direction is about 80 inches and the width in the Y-axis direction is about 60 inches. Of course, the mattress 1-1 can be any conventional size as described in connection with FIG. 6 through FIG. 23.

In FIG. 27, the mattress 1-1 includes an indicator stripe 10-M that indicates the location of the thoracic section 10-2 of the mattress 1-1. The indicator stripe 10-M includes indicia such as text which identifies the head direction 5-1' of the mattress 1-1 as well as indicating the location of the thoracic section 10-2 beneath it generally as described in connection with FIG. 2 and FIG. 3. Typically, the indicator stripe 10-M is part of the cover 3 and is weaved into the cover material 3. The cover 3 is a stretchable fabric which stretches in the X-axis, Y-axis and Z-axis directions so as not to interfere with the varying displacement parameters of the mattress 1-1 function in order to support the recumbent bodies 135 and 136 with low body pressure and alignment.

Figure 28:
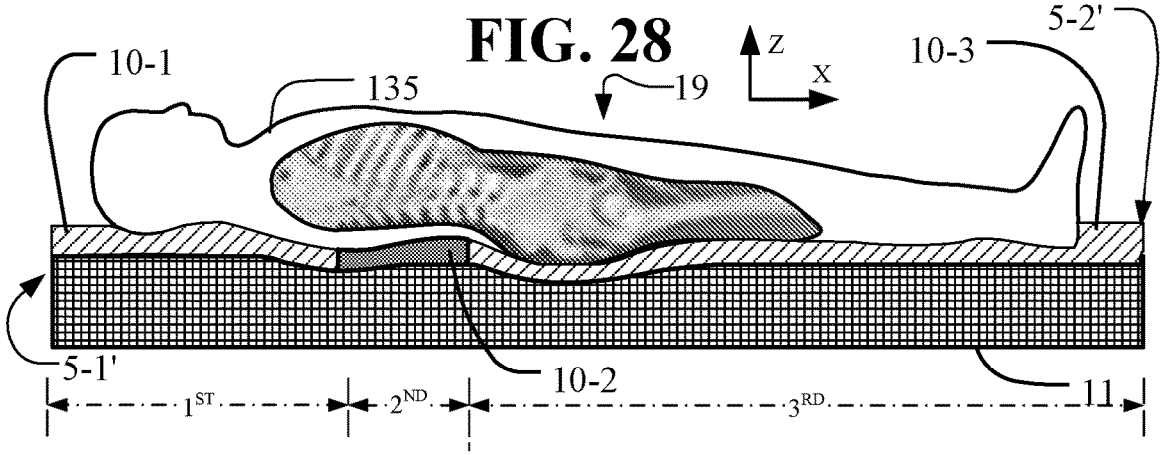
FIG. 28 depicts the male body of FIG. 27 with a cutaway view to show the skeleton and its position over the mattress composite.

In FIG. 28, a sectional cutaway side view of the mattress 1-1 of FIG. 27 is shown with a male body 135 recumbent on his back. The cutaway reveals the thoracic and pelvic girdle regions including the lumbar vertebrae extending from the thoracic $2^{ND}$ region into the hip and leg $3^{RD}$ region. The $3^{RD}$ region includes the coccyx, the sacrum and the coccygeal vertebrae. Because various relatively thick and wide muscles (glutei muscles), tendons and ligaments are present in the $3^{RD}$ region for a back-lying body, the pressure exerted by the back-lying body on the mattress 1-1 is not as disturbing as the pressure for a side-lying body.

Referring generally to FIG. 1 and also to the other figures, the cover 3 is formed of a material which provides a soft, luxurious feel while allowing full-contour performance of the mattress. In order to permit full-contour performance, the cover 3 is formed of a material having a sretchabilty that does not interfere with operation of the performance layer 10. The performance layer 10 permits the shoulder region 10-1 and hip region 10-3 of the reclining body to depress deeper into the mattress at lower pressure than the depression of the thoracic region 10-2. A cover that does not adequately stretch increases the pressure on the shoulder region 10-1 and hip region 10-3 and impedes the depression in these regions. In general, it has been found that a cover that will stretch at least 12% in the X-axis direction and at least 16% in the Y-axis direction for male and female bodies with a full range of body weights within the 95 percentile is satisfactory. For example, a California King 84" long in the X-axis direction would stretch at least about 10" in the X-axis direction and a California King 72" wide in the Y-axis direction would stretch at least about 12" in the Y-axis direction.

The selection of the various materials and parameters for the mattress 1-1, including the cover 3, the performance layer 10, including the three sections 10-1, 10-2 and 10-3 and including the core 11 are made to enable persons to sleep with body pressure below the ischemic threshold.

Although the embodiments described are representative, many variations in the mattresses are also included. One variation includes a performance layer 10 (referring generally to FIG. 1 and also to the other figures) in the composite $1_1$ made of latex. In one latex embodiment for performance layer 10, the section 10-1 has a 19 ILD and a 3.5 lb/cf density, the section 10-2 has a 28 ILD and a 3.5 lb/cf density and the section 10-3 has a 24 ILD and a 3.5 lb/cf density. The core layer 11 is polyurethane and has an ILD of 36 and a 1.8 lb/cf density.

Although the embodiments described have used a core layer 11 of 7" with a performance layer of 3", the thickness of the core layer in the Z-axis direction is not critical to good full-contour performance. Other typical core layer sizes are 10" and 12" but any core level thickness is acceptable to adjust the overall height of the composite $1_1$ and the mattress 1-1. The performance layer 10 is important for establishing good full-contour performance. Contour performance is achieved when a recumbent body is supported with low body pressure (generally below the ischemic threshold). In general, the performance layer can be increased in size by approximately 20% or more.

An efficient mattress which achieves good full-contour performance must also achieve efficient manufacturability and low cost. Embodiments of the mattress achieve these objectives due to a number of parameters and features. One feature is that the composite $1_1$ is simple in that it is formed with only two layers, a performance layer 10 and a core layer 11. The performance layer 10 is located at the top of the composite $1_1$. Being at the top and just below the cover, a need for other foam layers is eliminated thereby providing a simple structure which reduces parts and cost of assembly. The performance layer 10 is supported by the robust core layer 11. The core layer 11 in one embodiment is polyurethane foam with an ILD of 36, and a density of 1.8 lb/cf. These values for core layer 11 mean that core layer 11 will tend not to sag over the life time of the mattress and hence provide the mattress 1-1 with long life properties. The performance layer 10 is in itself simple in that only three sections, section 10-1, section 10-2 and section 1-3, are provided and hence only two vertical glue seems are required to form the performance layer 10, one between section 10-1 and section 10-2 and one between section 10-2 and section 10-3. Generally, the fewer the number of glue sections, the lower the cost. The performance layer 10 and cover 3 permit the dissipation of moisture and heat. The horizontal glue seem between the performance layer 10 and the core layer 11 is a sufficient distance from the mattress top, for example 3", so that the glue does not form a significant barrier to air circulation and heat dissipation.

The simple and efficient structure of the mattress 1-1 results in a unidirectional mattress 1-1 since the head of a recumbent body needs to be toward the head 5-1' of the mattress 1-1. The mattress is not reversible such that the head of the mattress 1-1 can be toward the foot 5-2 of the bed 1 (see FIG. 1) while the head of the recumbent body is toward the foot 5-2' of the mattress 1-1.

The simple and efficient structure of the mattress 1-1 renders the mattress easily compressed, folded and roll packed for easy shipping and delivery in compact form. In the folding, the vertical seems of glue between section 10-1 and section 10-2 and between section 10-2 and section 10-3 are folded so as to be toward the outside. The mattresses of FIG. 1 and FIG. 2, for any of the sizes of TABLE 1, in such compact form is easily packaged in a 19" by 19" by 44" box or smaller. The mattress is initially placed in a plastic bag. The mattress in the plastic bag is compressed from approximately 10" or more in the Z-axis direction to approximately 4" and then the plastic bag is sealed airtight to maintain the mattress in the compressed state. Thereafter, the compressed mattress is folded in the middle along the longitudinal direction. The folded mattress is then rolled with a diameter that is less than approximately 19".

The foam mattress 1-1 has significant pressure reduction on the prominences of a body with simultaneous improvement of spinal alignment. Even though the mattress 1-1 is flat in appearance, a reclining body pleasantly feels the full-contour performance especially at the shoulder and the hip and the causes of sleep-disturbance common to other mattresses are dramatically reduced.

While the invention has been particularly shown and described with reference to preferred embodiments thereof it will be understood by those skilled in the art that various changes in form and details may be made therein without departing from the scope of the invention.

The invention claimed is:

1. A mattress, extending in a lateral direction from side to side and extending in a longitudinal direction from a mattress head to a mattress foot for supporting a recumbent body where the body includes a shoulder region, a thoracic region and a hip region, the recumbent body having a displacement profile where the body displacements in the shoulder region, the thoracic region and the hip region, respectively, are different, the mattress consisting of:

a composite with a top, sides and a bottom, extending in the longitudinal direction and in the lateral direction, the composite consisting of:

a performance layer consisting of a shoulder section, a thoracic section and a hip section for location at different longitudinal positions corresponding to the shoulder region, the thoracic region and the hip region of the recumbent body, respectively, the shoulder section, the thoracic section and the hip section each having different displacement parameters, Indentation Load Deflection (ILD) and density, wherein the ILD of the thoracic section is greater than the ILD of the shoulder section and the ILD of the hip section, to match the body displacements in the shoulder region, the thoracic region, and the hip region, respectively, for alignment of the body with low body pressure, the performance layer having a glue interface between the shoulder section and the thoracic section and between thoracic section and the hip section, and a core layer directly attached to the performance layer on a bottom side thereof in the lateral direction and the longitudinal direction of the composite, and a cover with a top, sides and a bottom encapsulating the composite.

2. The mattress of claim 1 wherein the ILD of the shoulder section is 18, the ILD of the thoracic section is 27 and the ILD of the hip section is 23.

3. The mattress of claim 1 wherein the ILD of the shoulder section is 18, the ILD of the thoracic section is 27 and the ILD of the hip section is 23 and wherein the density of the shoulder section is 21b/cf, the density of the thoracic section is 21b/cf and the density of the hip section is 2 lb/cf.

4. The mattress of claim 1 wherein the core layer has an ILD of 36 and a density of 1.8 lb/cf.

5. The mattress of claim 1 wherein the performance layer and the core layer are each polyurethane or latex.

6. The mattress of claim 1 wherein the performance layer and the core layer are each one or more of rubber, plastic, latex, memory foam, urethane, and polyurethane polymer.

7. The mattress of claim 1 wherein the performance layer is latex and the core layer is polyurethane.

8. The mattress of claim 1 wherein the cover includes a stretch material that allows depression of the body into the composite without significantly modifying load deflection parameters of the composite.

9. The mattress of claim 8 wherein the stretch material has a tensile strength that allows the cover to stretch at least 12% in the longitudinal direction and at least 16% in the lateral direction when a recumbent body is on the mattress.

10. The mattress of claim 1 wherein the cover includes a stretch material covering the top and the sides of the composite.

11. The mattress of claim 1 wherein the cover includes a stretch material covering the top and the sides of the composite and extending to the bottom of the composite, said cover further including a zipper for zippering the stretch material to the non-stretch material on the bottom.

12. The mattress of claim 1 wherein the cover includes a stretch material covering the top and the sides and includes an indicator stripe superimposed over the thoracic section of the performance layer and woven into the stretch material for indicating a location of the thoracic section of the performance layer.

13. A mattress, extending in a lateral direction from side to side and extending in a longitudinal direction from a mattress head to a mattress foot for supporting a recumbent body where the body includes a shoulder region, a thoracic region and a hip region, the recumbent body having a displacement profile where body displacements in the shoulder region, the thoracic region and the hip region are different, the mattress consisting of:

a composite with a top, sides and a bottom, extending in the longitudinal direction and in the lateral direction, the composite consisting of:

a performance layer consisting of a shoulder section, a thoracic section and a hip section for location at different longitudinal positions corresponding to the shoulder region, the thoracic region and the hip region of the recumbent body, respectively, the shoulder section, the thoracic section and the hip section, each having different displacement parameters, Indentation Load Deflection (ILD) and density, to match the body displacements in the shoulder region, the thoracic region, and the hip region, respectively, for alignment of the body with low body pressure, the displacement parameters including ILD and density wherein the ILD of the thoracic section is greater than the ILD of the shoulder section and is greater than the ILD of the hip section, the performance layer having a glue interface between the shoulder section and the thoracic section and between the thoracic section and the hip section, and a core layer directly attached to the performance layer on a bottom side thereof in the lateral direction and the longitudinal direction of the composite, wherein the core layer has an ILD and wherein the ILD of the core layer is greater than the ILD of the thoracic section, and a cover with a top, a bottom and sides encapsulating the composite wherein the cover includes a stretch material that allows depression of the body into the composite without significantly modifying load deflection parameters of the composite.

14. The mattress of claim 13 wherein the ILD of the shoulder section is 18, the ILD of the thoracic section is 27 and the ILD of the hip section is 23.

15. The mattress of claim 13 wherein the ILD of the shoulder section is 18, the ILD of the thoracic section is 27 and the ILD of the hip section is 23 and wherein the density of the shoulder section is 21b/cf, the density of the thoracic section is 21b/cf and the density of the hip section is 2 lb/cf.

16. The mattress of claim 13 wherein the core layer has an ILD of 36 and a density of 1.8 lb/cf.

17. The mattress of claim 13 wherein the performance layer is latex and the shoulder section has an ILD of 19 and a density of 3.5 lb/cf, the thoracic section has an ILD of 28 and a density of 3.5 lb/cf and the hip section has an ILD of 24 and a density of 3.5 lb/cf and wherein the core layer is polyurethane and has an ILD of approximately 36 and a density of approximately 1.81b/cf.

18. A mattress, extending in a lateral direction from side to side and extending in a longitudinal direction from a mattress head to a mattress foot for supporting a recumbent body where the body includes a shoulder region, a thoracic region and a hip region, the recumbent body having a displacement profile where body displacements in the shoulder region, the thoracic region and the hip region are different, the mattress consisting of:

a composite with a top, sides and a bottom, extending in the longitudinal direction and in the lateral direction, the composite consisting of:

a performance layer consisting of a shoulder section, a thoracic section and a hip section for location at different longitudinal positions corresponding to the shoulder region, the thoracic region and the hip region of the recumbent body, respectively, the shoulder section, the thoracic section and the hip section each having different displacement parameters to match body displacements in the shoulder region, the thoracic region, and the hip region, respectively, for alignment of the body with low body pressure, the displacement parameters including ILD and density wherein the ILD of the thoracic section is greater than the ILD of the shoulder section and is greater than the ILD of the hip section, the performance layer having a glue interface between the shoulder section and the thoracic section and between the thoracic section and the hip section, the thoracic section and the hip section providing a tactile indication of the location of the thoracic region of the performance layer, and a core layer directly attached to the performance layer on a bottom side thereof in the lateral direction and the longitudinal direction of the composite, wherein the core layer has an ILD and wherein the ILD of the core layer is greater than the ILD of the thoracic section, and a cover with a top, a bottom and sides encapsulating the composite wherein the cover includes a stretch material that allows depression of the body into the composite without significantly modifying load deflection parameters of the composite.

* * * * *